US012691326B2

(12) United States Patent
Rogus

(10) Patent No.: US 12,691,326 B2
(45) Date of Patent: Jul. 28, 2026

(54) EXERCISE MACHINES HAVING ADJUSTABLE ELLIPTICAL STRIDING MOTION

(71) Applicant: Life Fitness, LLC, Franklin Park, IL (US)

(72) Inventor: John M. Rogus, Northbrook, IL (US)

(73) Assignee: Life Fitness, LLC, Rosemont, IL (US)

( * ) Notice: Subject to any disclaimer, the term of this patent is extended or adjusted under 35 U.S.C. 154(b) by 700 days.

(21) Appl. No.: 17/867,062

(22) Filed: Jul. 18, 2022

(65) Prior Publication Data

US 2023/0025399 A1 Jan. 26, 2023

Related U.S. Application Data

(60) Provisional application No. 63/223,630, filed on Jul. 20, 2021.

(51) Int. Cl.
*A63B 22/06* (2006.01)
*A63B 22/00* (2006.01)
*A63B 24/00* (2006.01)

(52) U.S. Cl.
CPC ..... *A63B 22/0664* (2013.01); *A63B 22/0023* (2013.01); *A63B 24/0087* (2013.01); *A63B 2022/067* (2013.01)

(58) Field of Classification Search
CPC ..... A63B 22/0664; A63B 22/0023; A63B 24/0087; A63B 2022/067; A63B 22/0015; A63B 22/001
See application file for complete search history.

(56) References Cited

U.S. PATENT DOCUMENTS 2,641,249 A 6/1953 Brockman
3,316,898 A 5/1967 Brown
(Continued)

FOREIGN PATENT DOCUMENTS

CN 104353219 A 2/2015
CN 105013139 A 11/2015
(Continued)

OTHER PUBLICATIONS

Hybrid Generator Brake (FB6), Chi Hua Fitness Co., http://www.chihua.com.tw/zh-tw/product, date website visited Jun. 25, 2018.
(Continued)

*Primary Examiner* — Megan Anderson
*Assistant Examiner* — Jacqueline N L Loberiza
(74) *Attorney, Agent, or Firm* — ANDRUS INTELLECTUAL PROPERTY LAW, LLP

(57) ABSTRACT

An exercise machine is for performing a striding exercise motion. The exercise machine has a frame, first and second pedal members, first and second foot pads on the first and second pedal members, respectively, wherein the first and second foot pads are configured to move in respective elliptical paths during the striding exercise motion, and first and second rocker arms. The first and second pedal members are pivotably coupled to the first and second rocker arms and move with the first and second rocker arms relative to the frame. An adjustment device pivotably couples the first and second rocker arms to the frame. The adjustment device is configured to actively adjust and set a position of the first and second rocker arms relative to the frame, respectively, which thereby changes an incline shape of the elliptical paths, respectively, during the striding exercise motion.

7 Claims, 19 Drawing Sheets

(56) References Cited

U.S. PATENT DOCUMENTS 3,917,261 A 11/1975 Small et al.
4,376,532 A 3/1983 Hunstad
4,408,613 A 10/1983 Relyca
4,587,960 A 5/1986 Schotten
4,786,050 A 11/1988 Geschwender
4,915,375 A 4/1990 Ginsburg
5,067,710 A 11/1991 Watterson et al.
5,135,447 A 8/1992 Robards, Jr. et al.
5,149,084 A 9/1992 Dalebout et al.
5,242,343 A 9/1993 Miller
5,290,211 A 3/1994 Stearns
5,383,829 A 1/1995 Miller
5,411,454 A 5/1995 Chang
5,419,751 A 5/1995 Byrd et al.
5,478,295 A 12/1995 Fracchia
5,499,956 A 3/1996 Habing et al.
5,540,637 A 7/1996 Rodgers, Jr.
5,562,574 A 10/1996 Miller
5,573,480 A 11/1996 Rodgers, Jr.
5,624,356 A 4/1997 Roberts
5,685,804 A 11/1997 Whan Tong et al.
5,743,834 A 4/1998 Rodgers, Jr.
5,759,136 A 6/1998 Chen
5,762,588 A 6/1998 Chen
5,779,599 A 7/1998 Chen
5,785,632 A 7/1998 Greenberg et al.
5,788,610 A 8/1998 Eschenbach
5,792,026 A 8/1998 Maresh et al.
5,803,871 A 9/1998 Stearns et al.
5,836,854 A 11/1998 Kuo
5,836,855 A 11/1998 Eschenbach
5,848,954 A 12/1998 Stearns et al.
5,857,941 A 1/1999 Maresh et al.
5,882,281 A 3/1999 Stearns et al.
5,893,820 A 4/1999 Maresh
5,895,339 A 4/1999 Maresh
5,899,833 A 5/1999 Ryan et al.
5,919,118 A 7/1999 Stearns et al.
5,921,894 A 7/1999 Eschenbach
5,928,113 A 7/1999 Roberts
5,938,568 A 8/1999 Maresh et al.
5,947,872 A 9/1999 Ryan et al.
5,957,814 A 9/1999 Eschenbach
5,993,359 A 11/1999 Eschenbach
6,007,462 A 12/1999 Chen
6,027,430 A 2/2000 Stearns et al.
6,027,431 A 2/2000 Stearns et al.
6,030,320 A 2/2000 Stearns et al.
6,042,512 A 3/2000 Eschenbach
6,045,488 A 4/2000 Eschenbach
6,053,847 A 4/2000 Stearns et al.
6,063,008 A 5/2000 McBride et al.
6,063,009 A 5/2000 Stearns et al.
6,077,196 A 6/2000 Eschenbach
6,077,197 A 6/2000 Stearns et al.
6,077,198 A 6/2000 Eschenbach
6,080,086 A 6/2000 Maresh et al.
6,090,013 A 7/2000 Eschenbach
6,090,014 A 7/2000 Eschenbach
6,099,439 A 8/2000 Ryan et al.
6,113,518 A 9/2000 Maresh et al.
6,126,574 A 10/2000 Stearns et al.
6,135,923 A 10/2000 Stearns et al.
6,146,313 A 11/2000 Whan Tong et al.
6,168,552 B1 1/2001 Eschenbach
6,171,215 B1 1/2001 Stearns et al.
6,176,814 B1 1/2001 Ryan et al.
6,196,948 B1 3/2001 Stearns et al.
6,203,474 B1 3/2001 Jones
6,206,804 B1 3/2001 Maresh
6,210,305 B1 4/2001 Eschenbach
6,217,485 B1 4/2001 Maresh
6,217,486 B1 4/2001 Rosenow
6,248,044 B1 6/2001 Stearns et al.
6,248,045 B1 6/2001 Stearns et al.
6,248,046 B1 6/2001 Maresh et al.
6,254,514 B1 7/2001 Maersh et al.
6,277,054 B1 8/2001 Kuo
6,283,895 B1 9/2001 Stearns et al.
6,302,825 B1 10/2001 Stearns et al.
6,302,830 B1 10/2001 Stearns
6,312,362 B1 11/2001 Maresh et al.
6,334,836 B1 1/2002 Segasby
6,338,698 B1 1/2002 Stearns et al.
6,340,340 B1 1/2002 Stearns et al.
6,361,476 B1 3/2002 Eschenbach
6,387,017 B1 5/2002 Maresh
6,390,953 B1 5/2002 Maresh et al.
6,416,442 B1 7/2002 Stearns et al.
6,422,977 B1 7/2002 Eschenbach
6,436,007 B1 8/2002 Eschenbach
6,440,042 B2 8/2002 Eschenbach
6,450,922 B1 9/2002 Henderson et al.
6,450,925 B1 9/2002 Kuo
6,454,682 B1 9/2002 Kuo
6,458,060 B1 10/2002 Watterson et al.
6,461,277 B2 10/2002 Maresh et al.
6,482,130 B1 11/2002 Pasero et al.
6,516,683 B2 2/2003 Sundaresan et al.
6,540,646 B2 4/2003 Stearns et al.
6,544,146 B1 4/2003 Stearns et al.
6,547,701 B1 4/2003 Eschenbach
6,554,750 B2 4/2003 Stearns et al.
6,565,486 B2 5/2003 Stearns et al.
6,569,061 B2 5/2003 Stearns et al.
6,579,210 B1 6/2003 Stearns et al.
6,610,382 B1 8/2003 Kobe et al.
6,612,969 B2 9/2003 Eschenbach
6,620,079 B2 9/2003 Kuo
6,629,909 B1 10/2003 Stearns et al.
6,645,125 B1 11/2003 Stearns et al.
6,672,992 B1 1/2004 Lo et al.
6,689,020 B2 2/2004 Stearns et al.
6,726,600 B2 4/2004 Miller
6,758,115 B2 7/2004 Allen et al.
6,830,538 B2 12/2004 Eschenbach
6,846,272 B2 1/2005 Rosenow et al.
6,905,442 B1 6/2005 Lee et al.
6,991,587 B1 1/2006 Eschenbach
6,997,852 B2 2/2006 Watterson et al.
7,025,711 B2 4/2006 Eschenbach
7,033,305 B1 4/2006 Stearns et al.
7,037,242 B2 5/2006 Lo et al.
7,041,034 B1 5/2006 Stearns et al.
7,052,438 B2 5/2006 Eschenbach
7,060,004 B2 6/2006 Kuo
7,097,591 B2 8/2006 Moon
7,097,592 B2 8/2006 Wang
7,101,316 B2 9/2006 Rosenow et al.
7,131,935 B2 11/2006 Wang
7,153,239 B1 12/2006 Stearns et al.
7,169,088 B2 1/2007 Rodgers, Jr.
7,169,090 B1 1/2007 Maresh
7,264,576 B2 9/2007 Gerschefske et al.
7,270,626 B2 9/2007 Porth
7,270,628 B2 9/2007 Campanaro et al.
7,344,480 B2 3/2008 Maresh et al.
7,361,122 B2 4/2008 Porth
7,435,202 B2 10/2008 Daly et al.
7,448,986 B1 11/2008 Porth
7,455,624 B2 11/2008 Liao Lai
7,507,186 B2 3/2009 Stearns et al.
7,559,879 B2 7/2009 Anderson et al.
7,670,268 B1 3/2010 Stearns et al.
7,682,290 B2 3/2010 Liao et al.
7,691,035 B2 4/2010 Chen et al.
7,708,669 B2 5/2010 Rodgers, Jr.
7,722,505 B2 5/2010 Liao et al.
7,740,564 B2 6/2010 Shen
7,749,137 B2 7/2010 Watt et al.
7,758,473 B2 7/2010 Lull et al.
7,785,235 B2 8/2010 Lull et al.
7,803,089 B2 9/2010 Roimicher et al.
7,811,206 B2 10/2010 Chuang et al.

(56) References Cited

U.S. PATENT DOCUMENTS

| | | | | |
|---|---|---|---|---|
| 7,878,949 | B2 | 2/2011 | Chen | |
| 7,918,766 | B2 | 4/2011 | Lu et al. | |
| 7,931,566 | B1 | 4/2011 | Radke et al. | |
| 8,021,274 | B2 | 9/2011 | Anderson et al. | |
| 8,079,937 | B2 * | 12/2011 | Bedell | A63B 22/001 482/4 |
| 8,092,349 | B2 | 1/2012 | Liao et al. | |
| 8,133,159 | B2 | 3/2012 | Eschenbach | |
| 8,235,873 | B1 | 8/2012 | Stearns et al. | |
| 8,272,997 | B2 | 9/2012 | Anderson et al. | |
| 8,376,913 | B2 | 2/2013 | Lee et al. | |
| 8,403,815 | B2 | 3/2013 | Liao et al. | |
| 8,419,598 | B2 | 4/2013 | Dyer et al. | |
| 8,449,437 | B1 | 5/2013 | Maresh et al. | |
| 8,540,609 | B2 | 9/2013 | Anderson et al. | |
| 8,668,627 | B2 | 3/2014 | Eschenbach | |
| 8,827,870 | B2 | 9/2014 | Dyer et al. | |
| 8,864,631 | B1 | 10/2014 | Stearns et al. | |
| 9,038,577 | B1 | 5/2015 | Lankinen | |
| 9,039,577 | B2 | 5/2015 | Peng | |
| 9,044,640 | B2 | 6/2015 | Lo et al. | |
| 9,050,498 | B2 | 6/2015 | Lu et al. | |
| 9,126,078 | B2 | 9/2015 | Anderson et al. | |
| 9,138,614 | B2 | 9/2015 | Lu et al. | |
| 9,283,425 | B2 | 3/2016 | Lu et al. | |
| 9,339,684 | B2 | 5/2016 | Liao et al. | |
| 9,381,394 | B2 | 7/2016 | Mortensen et al. | |
| 9,403,585 | B2 | 8/2016 | Arad | |
| 9,511,253 | B1 * | 12/2016 | Miller | A63B 22/0015 |
| 9,586,085 | B2 | 3/2017 | Arnold et al. | |
| 9,604,096 | B2 | 3/2017 | Arnold et al. | |
| 9,764,187 | B1 | 9/2017 | Stearns et al. | |
| 9,808,667 | B2 | 11/2017 | Liao et al. | |
| 9,925,412 | B1 | 3/2018 | Lu | |
| 10,201,727 | B2 | 2/2019 | Ohrt et al. | |
| 10,252,101 | B2 | 4/2019 | Yim et al. | |
| 10,369,403 | B2 | 8/2019 | Liao et al. | |
| 10,478,665 | B1 | 11/2019 | Daly et al. | |
| 10,532,246 | B2 | 1/2020 | Liao et al. | |
| 10,543,396 | B2 | 1/2020 | Yim et al. | |
| 10,561,891 | B2 | 2/2020 | Luger et al. | |
| 10,653,914 | B2 | 5/2020 | Ellis et al. | |
| 10,654,914 | B2 | 5/2020 | Abend et al. | |
| 10,946,238 | B1 | 3/2021 | Rogus | |
| 2001/0051562 | A1 | 12/2001 | Stearns et al. | |
| 2002/0019298 | A1 | 2/2002 | Eschenbach | |
| 2002/0032104 | A1 | 3/2002 | Rosenow et al. | |
| 2002/0055420 | A1 | 5/2002 | Stearns et al. | |
| 2002/0077220 | A1 | 6/2002 | Kuo | |
| 2002/0094914 | A1 | 7/2002 | Maresh et al. | |
| 2002/0119867 | A1 | 8/2002 | Stearns et al. | |
| 2002/0142890 | A1 | 10/2002 | Ohrt et al. | |
| 2002/0151411 | A1 | 10/2002 | Stearns et al. | |
| 2002/0198084 | A1 | 12/2002 | Stearns et al. | |
| 2003/0027690 | A1 | 2/2003 | Miller | |
| 2003/0045401 | A1 | 3/2003 | Watterson et al. | |
| 2004/0097339 | A1 | 5/2004 | Moon | |
| 2004/0209741 | A1 | 10/2004 | Kuo | |
| 2005/0028660 | A1 | 2/2005 | Chin-Chin | |
| 2005/0043148 | A1 | 2/2005 | Maresh | |
| 2005/0049118 | A1 | 3/2005 | Rosenow et al. | |
| 2005/0085344 | A1 | 4/2005 | Eschenbach | |
| 2005/0124466 | A1 | 6/2005 | Rodgers | |
| 2005/0164837 | A1 | 7/2005 | Anderson et al. | |
| 2005/0181911 | A1 | 8/2005 | Porth | |
| 2005/0209056 | A1 | 9/2005 | Daly et al. | |
| 2005/0245361 | A1 | 11/2005 | Wu et al. | |
| 2006/0189446 | A1 | 8/2006 | Rogus | |
| 2006/0247103 | A1 | 11/2006 | Stearns et al. | |
| 2006/0252604 | A1 * | 11/2006 | Moon | A63B 22/001 482/52 |
| 2006/0281604 | A1 | 12/2006 | Stewart | |
| 2007/0032350 | A1 | 2/2007 | Alessandri et al. | |
| 2007/0037666 | A1 | 2/2007 | Gagnon et al. | |
| 2007/0087903 | A1 | 4/2007 | Lee et al. | |
| 2007/0117683 | A1 | 5/2007 | Ercanbrack et al. | |
| 2007/0179023 | A1 | 8/2007 | Dyer | |
| 2007/0238582 | A1 | 10/2007 | Lee | |
| 2007/0298936 | A1 | 12/2007 | Ohrt et al. | |
| 2008/0051258 | A1 | 2/2008 | Schmehl et al. | |
| 2008/0200314 | A1 | 8/2008 | Dalebout | |
| 2008/0280731 | A1 | 11/2008 | Dalebout | |
| 2008/0280735 | A1 | 11/2008 | Dickie et al. | |
| 2008/0300114 | A1 | 12/2008 | Dalebout | |
| 2009/0291809 | A1 | 11/2009 | Chen | |
| 2010/0167877 | A1 | 7/2010 | Grind | |
| 2010/0248899 | A1 | 9/2010 | Bedell et al. | |
| 2010/0317492 | A1 | 12/2010 | Nelson | |
| 2012/0190507 | A1 | 7/2012 | Murray | |
| 2013/0210585 | A1 | 8/2013 | Arnold | |
| 2013/0310225 | A1 | 11/2013 | Johnson | |
| 2014/0194254 | A1 | 7/2014 | Huang | |
| 2014/0309086 | A1 | 10/2014 | Chuang | |
| 2015/0057129 | A1 | 2/2015 | Lo | |
| 2015/0087481 | A1 | 3/2015 | Liu | |
| 2015/0238807 | A1 | 8/2015 | Long | |
| 2015/0343262 | A1 | 12/2015 | Su | |
| 2016/0158595 | A1 * | 6/2016 | Dalebout | A63B 23/04 482/52 |
| 2016/0339295 | A1 * | 11/2016 | Lin | A63B 21/0059 |
| 2017/0274244 | A1 | 9/2017 | Chang et al. | |
| 2018/0036582 | A1 | 2/2018 | Liao | |
| 2018/0111019 | A1 * | 4/2018 | Ellis | A63B 22/0023 |
| 2020/0346069 | A1 | 11/2020 | Tracy | |
| 2021/0275866 | A1 * | 9/2021 | Rogus | A63B 22/001 |

FOREIGN PATENT DOCUMENTS

| | | | | |
|---|---|---|---|---|
| EP | 1666101 | A1 * | 6/2006 | A63B 22/0023 |
| EP | 2223722 | | 9/2010 | |
| TW | 201034717 | A † | 10/2010 | |
| TW | 201615240 | A | 5/2016 | |
| TW | I579019 | | 4/2017 | |
| TW | I579019 | | 4/2017 | |
| TW | 201938229 | A | 10/2019 | |
| WO | WO 2008114291 | | 9/2008 | |

OTHER PUBLICATIONS

PCT/US2022/037565, International Preliminary Report on Patentability dated Jan. 18, 2024, 6 pages.

Office Action issued in EP Patent Application No. 22757720.2, dated Mar. 17, 2025.

Office Action issued in Taiwan Patent Application No. 111127227, dated Oct. 17, 2025.

Office Action issued in Chinese Patent Application No. 2022800633863, dated Apr. 20, 2026.

* cited by examiner
† cited by third party

EXERCISE MACHINES HAVING ADJUSTABLE ELLIPTICAL STRIDING MOTION

CROSS-REFERENCE TO RELATED APPLICATION

The present application claims the benefit of and priority to U.S. Provisional Patent Application No. 63/223,630, filed Jul. 20, 2021.

FIELD

The present disclosure relates to exercise machines, and particularly to exercise machines which facilitate adjustment of an elliptical striding motion by a user.

BACKGROUND

The following U.S. Patents are incorporated herein by reference:

U.S. Pat. Pub. No. 2021/0275866 discloses an exercise machine for performing a striding exercise motion. The exercise machine has a frame; first and second pedal members; first and second foot pads on the first and second pedal members, respectively, each of the first and second foot pads being movable along an elliptical path during said striding exercise motion; and first and second rocker arms each having a first end which is pivotable with respect to the frame about a rocker arm pivot axis and further having a second end which is pivotable with respect to one of the first and second pedal members about a pedal lever hub axis. The frame has first and second frame portions. The first frame portion supports the first and second rocker arms and is pivotable about a frame pivot axis relative to the second frame portion. Pivoting the first frame portion relative to the second frame portion adjusts a position of the rocker arm pivot axis, which thereby changes a shape of the elliptical path.

U.S. Pat. No. 10,946,238 discloses an exercise machine for performing a striding exercise motion. The machine has frame; first and second pedal members; first and second foot pads on the first and second pedal members, respectively, each of the first and second foot pads being configured to move in an elliptical path during the striding exercise motion; first and second rocker arms pivotably coupled to the frame; and first and second adjustment devices configured to actively adjust and set a position of the first and second pedal members relative to the first and second rocker arms, respectively, which thereby changes a shape of the elliptical path.

U.S. Pat. No. 10,478,665 discloses an exercise apparatus having a frame and first and second pedals which are coupled to the frame so that a user standing on the first and second pedals can perform a striding exercise. The first and second pedals each has a tread member which supports the bottom of a user's foot in a manner that encourages movement of the user's foot relative to the tread member during the striding exercise.

U.S. Pat. No. 9,925,412 discloses an exercise device including a linkage assembly which links a driving member to a driven member so that circular rotation of the driving member causes generally equal circular rotation of the driven member. The linkage assembly includes a linking member, a first crank arm which connects the driving member to the linking member so that rotation of the driving member causes motion of the linking member, and a second crank arm which connects the linking member to the driven member so that the motion of the linking member causes rotation of the driven member. At least one additional crank arm connects the linking member at a rotational axis which is laterally offset from a straight line through the first and second crank arm rotational axes.

U.S. Pat. No. 9,283,425 discloses an exercise assembly having a frame and elongated foot pedal members which are each movable along user-defined paths of differing dimensions. Each foot pedal member has a front portion and a rear portion. Footpads are disposed on the rear portion of one of the first and second foot pedal members. Elongated coupler arms have a lower portion and an upper portion which is pivotably connected to the frame. Crank members have a first portion which is pivotably connected to the front portion of one of the first and second foot pedal members and have a second portion which is pivotably connected to the lower portion of one of the first and second coupler arms, so that each crank member is rotatable in a circular path. Elongated rocker arms have a lower portion which is pivotably connected to one of the first and second foot pedal members in between the foot pad and the crank member and have an upper portion which is pivotably connected to the frame.

U.S. Pat. No. 9,138,614 discloses an exercise assembly having elongated first and second rocker arms which pivot with respect to each other in a scissors-like motion about a first pivot axis. A slider has a slider body which slides along a linear axis extending through and perpendicular to the first pivot axis. A linkage pivotably couples the first and second rocker arms to the slider body. Pivoting the first and second rocker arms with respect to each other causes the slider body to slide in a first direction along the linear axis. Opposite pivoting of the first and second rocker arms with respect to each other causes the slider body to slide in an opposite, second direction along the linear axis.

U.S. Pat. Nos. 9,126,078 and 8,272,997 disclose an elliptical step exercise apparatus in which a dynamic link mechanism can be used to vary the stride length of the machine. A control system can also be used to vary stride length as a function of various exercise and operating parameters such as speed and direction as well as varying stride length as a part of a preprogrammed exercise routine such as a hill or interval training program. In addition, the control system can use measurements of stride length to optimize operation of the apparatus.

U.S. Pat. No. 7,931,566 discloses an elliptical cross trainer which has a rotating inertial flywheel driven by user-engaged linkage exercising a user. A user-actuated brake engages and stops rotation of the flywheel upon actuation by the user.

U.S. Pat. No. 7,918,766 discloses an exercise apparatus for providing elliptical foot motion which utilizes a first and second rocking links suspended from an upper portion of the apparatus frame permitting at least limited arcuate motion of the lower portions of the links. Foot pedal assemblies are connected to rotating shafts or members located on the lower portion of the links so that the foot pedals will describe a generally elliptical path in response to user foot motion on the pedals.

U.S. Pat. No. 6,846,272 discloses an exercise apparatus having a frame which is adapted for placement on the floor, a pivot axle supported by the frame, a first and second pedal levers, pedals secured to the pedal levers, and arm handles connected for motion with the pedal levers and which can utilize a variety of pedal actuation assemblies for generating elliptical motion of the pedal. The stride length portion of the elliptical motion can be increased automatically as a function of exercise parameters such as speed. In addition, the arm handles can be disconnected manually or automatically from the pedal levers.

U.S. Pat. No. 6,217,486 discloses an exercise apparatus which includes a frame adapted for placement on the floor, a pivot axle supported by the frame, a bent pedal lever, a pedal which is secured to the bent pedal lever and a variety of pedal actuation assemblies. These pedal actuation assemblies include components which cooperate to provide an elliptical path and provide the desired foot flexure and weight distribution on the pedal. Consequently, as the pedal moves in its elliptical path, the angular orientation of the pedal, relative to a fixed, horizontal plane, such as the floor, varies in a manner which simulates a natural heel to toe flexure.

U.S. Pat. Nos. 6,203,474; 6,099,439; and 5,947,872 disclose an exercise apparatus including a frame which is adapted for placement on the floor, a pivot axis supported by the frame, a pedal bar which has first and second ends, a pedal which is secured to the pedal bar, an ellipse generator, and a track. The ellipse generator is secured to both the pivot axis and to the first end of the pedal bar so that the first end of said pedal bar moves in an elliptical path around the pivot axis. The track is secured to the frame and engages the second end of said pedal bar so that the second end moves in a linear reciprocating path as the first end of the pedal bar moves in the elliptical path around said pivot axis. Consequently, the pedal also moves in a generally elliptical path. As the pedal moves in its elliptical path, the angular orientation of the pedal, relative to a fixed, horizontal plane, such as the floor, varies in a manner which simulates a natural heel to toe flexure.

SUMMARY

This Summary is provided to introduce a selection of concepts which are further described below in the Detailed Description. This Summary is not intended to identify key or essential features of the claimed subject matter, nor is it intended to be used as an aid in limiting the scope of the claimed subject matter.

In non-limiting examples disclosed herein, an exercise machine is for performing a striding exercise motion. The exercise machine comprises a frame, first and second pedal members, first and second foot pads on the first and second pedal members, respectively, wherein the first and second foot pads are configured to move in respective elliptical paths during the striding exercise motion, and first and second rocker arms, wherein the first and second pedal members are pivotably coupled to the first and second rocker arms and move with the first and second rocker arms relative to the frame. An adjustment device pivotably couples the first and second rocker arms to the frame. The adjustment device is configured to actively adjust and set a position of the first and second rocker arms relative to the frame, respectively, which thereby changes an incline shape of the elliptical paths, respectively, during the striding exercise motion.

In non-limiting examples disclosed herein, the exercise machine further comprises first and second incline links which pivotably couple the first and second rocker arms to the frame. Each of the first and second incline links is pivotably coupled to the frame at an incline link-frame pivot axis, to a respective one of the first and second rocker arms at an incline link-rocker arm pivot axis, and to the adjustment device at an actuator-incline link pivot axis. The adjustment device is configured to pivot the first and second incline links rearwardly relative to the frame which moves the incline link-rocker arm pivot axis rearwardly relative to the frame, which raises the incline shape of the elliptical paths. The adjustment device is further configured to pivot the first and second incline links forwardly relative to the frame which moves the incline link-rocker arm pivot axis forwardly relative to the frame, which lowers the incline shape of the elliptical paths. In non-limiting examples, the adjustment device comprises first and second linear actuators each having a first end pivotably coupled to the frame and a second end pivotably coupled to a respective one of the first and second incline links.

In non-limiting examples disclosed herein, the first and second pedal members each has a front end portion which is pivotably coupled to a lower end portion of a respective one of the first and second rocker arms at a rocker arm-pedal member pivot axis so that each of the first and second pedal members is pivotably movable relative to the respective one of the first and second rocker arms and relative to the frame and so that pivoting of the first and second rocker arms relative to the frame causes commensurate pivoting and translating of the first and second pedal members relative to the frame.

In non-limiting examples disclosed herein, the exercise machine further comprises first and second handle members which are pivotably coupled to opposite sides of a bridge on the frame at a respective handle member-bridge pivot axis. Each of the first and second handle members comprises an upper end providing a hand grip for manually grasping by a user performing the striding exercise motion and a lower end which is pivotably coupled to a respective coupler link at a handle-member coupler link pivot axis so that the first and second handle members and coupler links pivot together about the respective handle member-bridge pivot axis, respectively. Each of the coupler links has a forward end portion coupled to a respective one of the first and second handle members at the handle-member coupler link pivot axis and a rearward end portion pivotably coupled to a central portion of the pedal member at a coupler link-pedal member pivot axis so that each coupler link is pivotable relative to the respective one of the pedal members about the coupler link-pedal member pivot axis.

In certain non-limiting examples disclosed herein, each of the first and second pedal members has a forward end pivotably coupled to the first and second rocker arms, respectively, and a rearward end pivotably coupled to a resistance device. First and second crank arms are radially opposed to each other and have a radially inner end that is rotatably fixed to a center shaft at a rear of the exercise machine, the center shaft being coupled to the resistance device. First and second stride links are pivotably coupled to radially outer ends of the first and second crank arms, respectively, and further are pivotably coupled to a tail portion of the first and second pedal members, respectively. First and second idler links have a first end which is pivotably coupled to a base member of the frame at an idler link-base member pivot axis and a second end which is pivotably coupled to a lower end of a respective one of the first and second stride links at a stride-link-idler link pivot axis.

In certain non-limiting examples disclosed herein, the adjustment device comprises an actuator configured to actively adjust and set the position of the first and second rocker arms relative to the frame, respectively, which thereby changes the incline shape of the elliptical paths, respectively, during the striding exercise motion. In some examples, the actuator is one of first and second linear actuators having a first end coupled to the frame and an opposite, second end pivotably coupled to the first and second rocker arms, respectively. The actuator can comprise an electric motor or a hydraulic piston-cylinder. In some examples, the actuator is a linear actuator which is supported by a carriage having a guide for supporting lengthening and shortening of the linear actuator. In some examples, the adjustment device comprises a pulley assembly and first and second rotary devices which are coupled to the pulley assembly and to the first and second rocker arms, respectively. In these examples, the actuator is configured to rotate the pulley assembly in a first direction which lengthens the first and second rotary devices and thus raise the incline shape of the elliptical paths, and further the actuator is also configured to rotate the pulley assembly in an opposite, second direction which shortens the first and second rotary devices and thus lower the incline shape of the elliptical paths. In some examples, the adjustment device comprises gear linkage and first and second rotary devices which are coupled to the gear linkage and to the first and second rocker arms, respectively. In these examples, the actuator is configured to rotate the gear linkage in a first direction which lengthens the first and second rotary devices and thus raise the incline shape of the elliptical paths, and further the actuator is also configured to rotate the gear linkage in an opposite, second direction which shortens the first and second rotary devices and thus lower the incline shape of the elliptical paths.

BRIEF DESCRIPTION OF THE DRAWINGS

The present disclosure is described with reference to the following Figures. The same numbers are used throughout the Figures to reference like features and like components. Unless otherwise specifically noted, articles illustrated in the drawings are not necessarily drawn to scale.

DETAILED DESCRIPTION OF THE DRAWINGS

Figure 1:
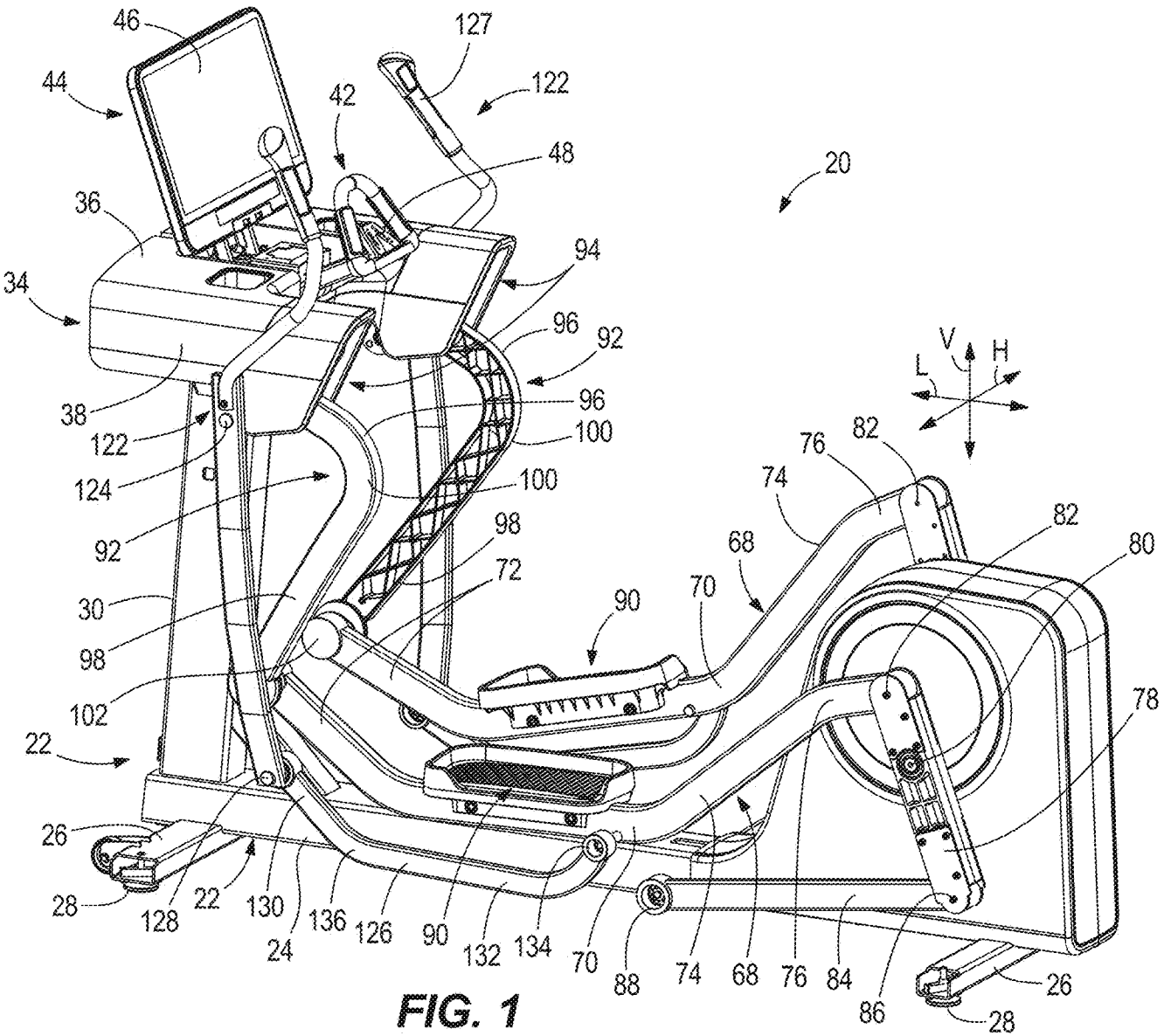
FIG. 1 is a side perspective view of a first non-limiting example of an exercise machine according to the present disclosure, having certain features removed such as support column, base member and stabilizer covers.
Figure 2:
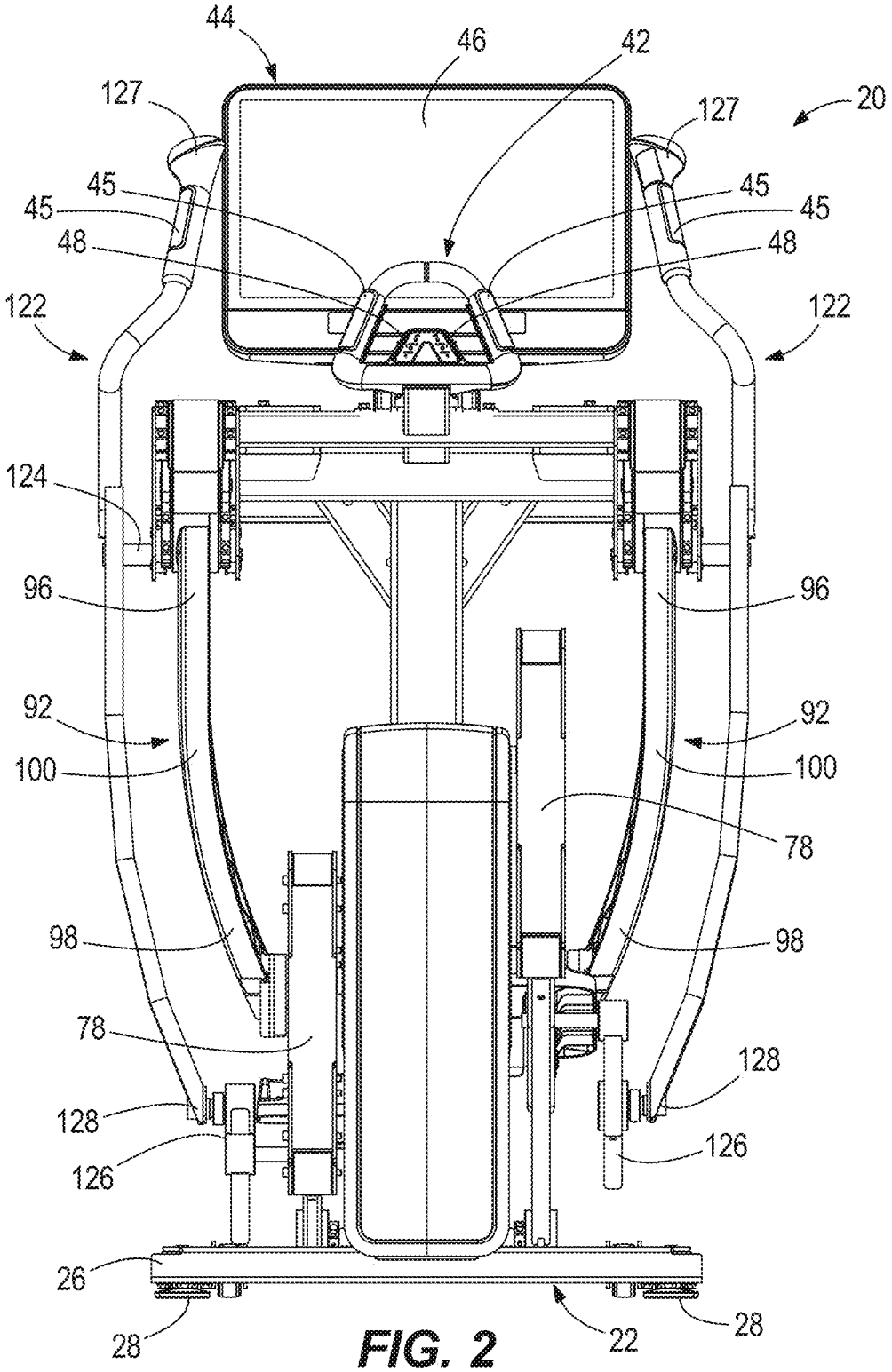
FIG. 2 is a rear view thereof having front a stabilizer covers removed.
Figure 3:
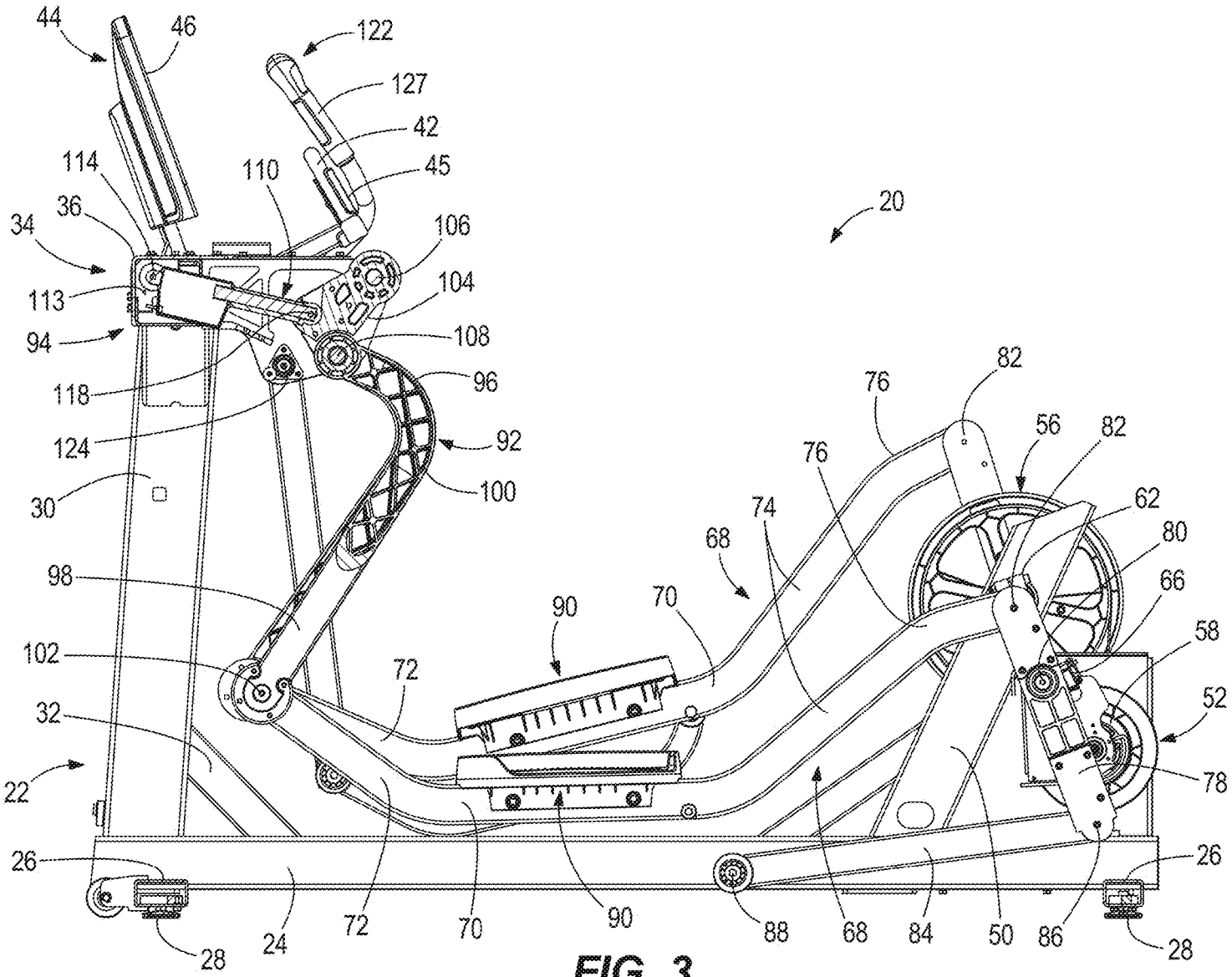
FIG. 3 is a side view thereof having front and rear covers removed.
Figure 4:
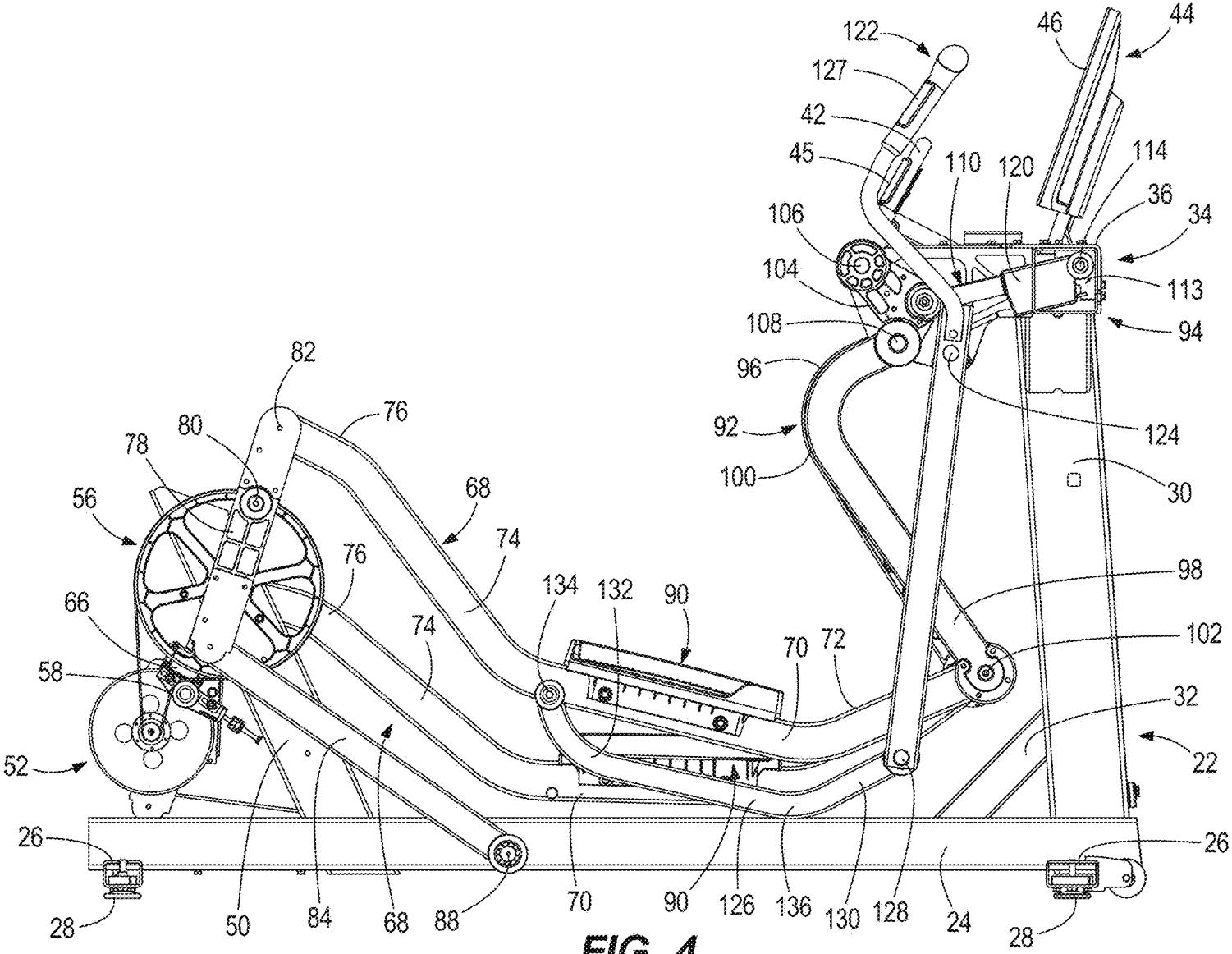
FIG. 4 is an opposite side view thereof having front and rear covers and stabilizer covers removed.
Figure 5:
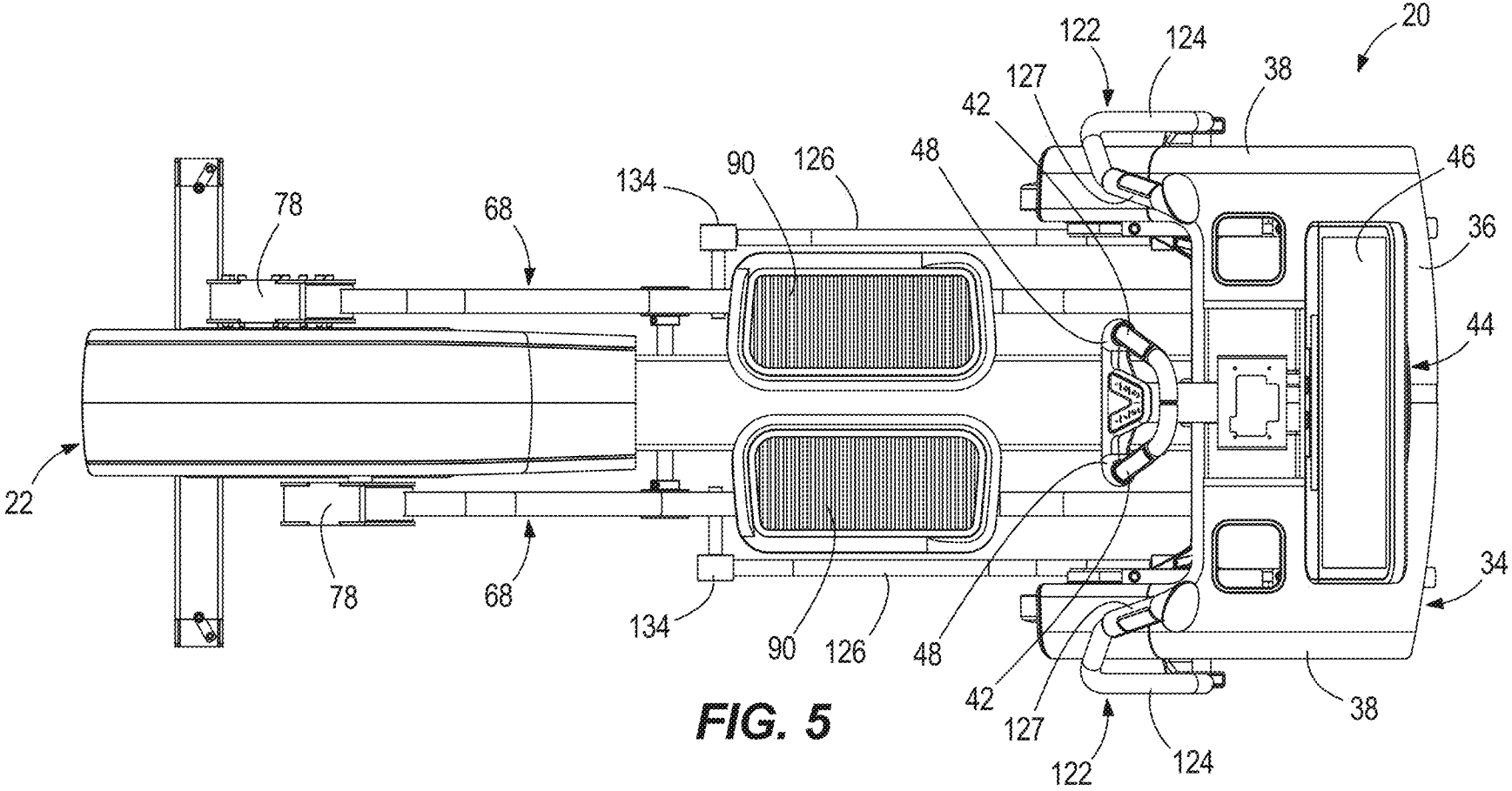
FIG. 5 is a top view thereof having base member and stabilizer covers removed.
Figure 6:
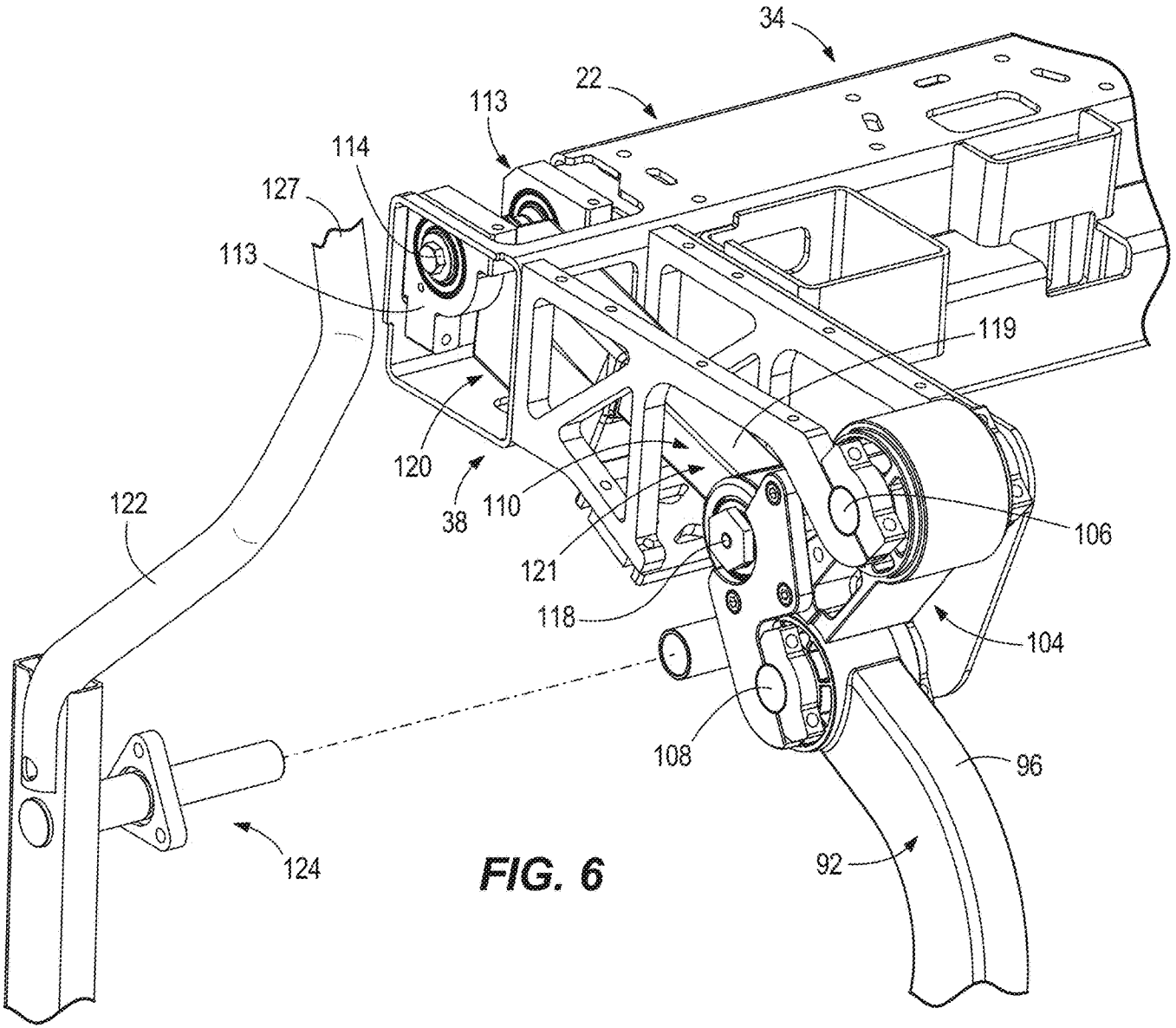
FIG. 6 is an exploded view of portions of the front of the machine.
Figure 7:
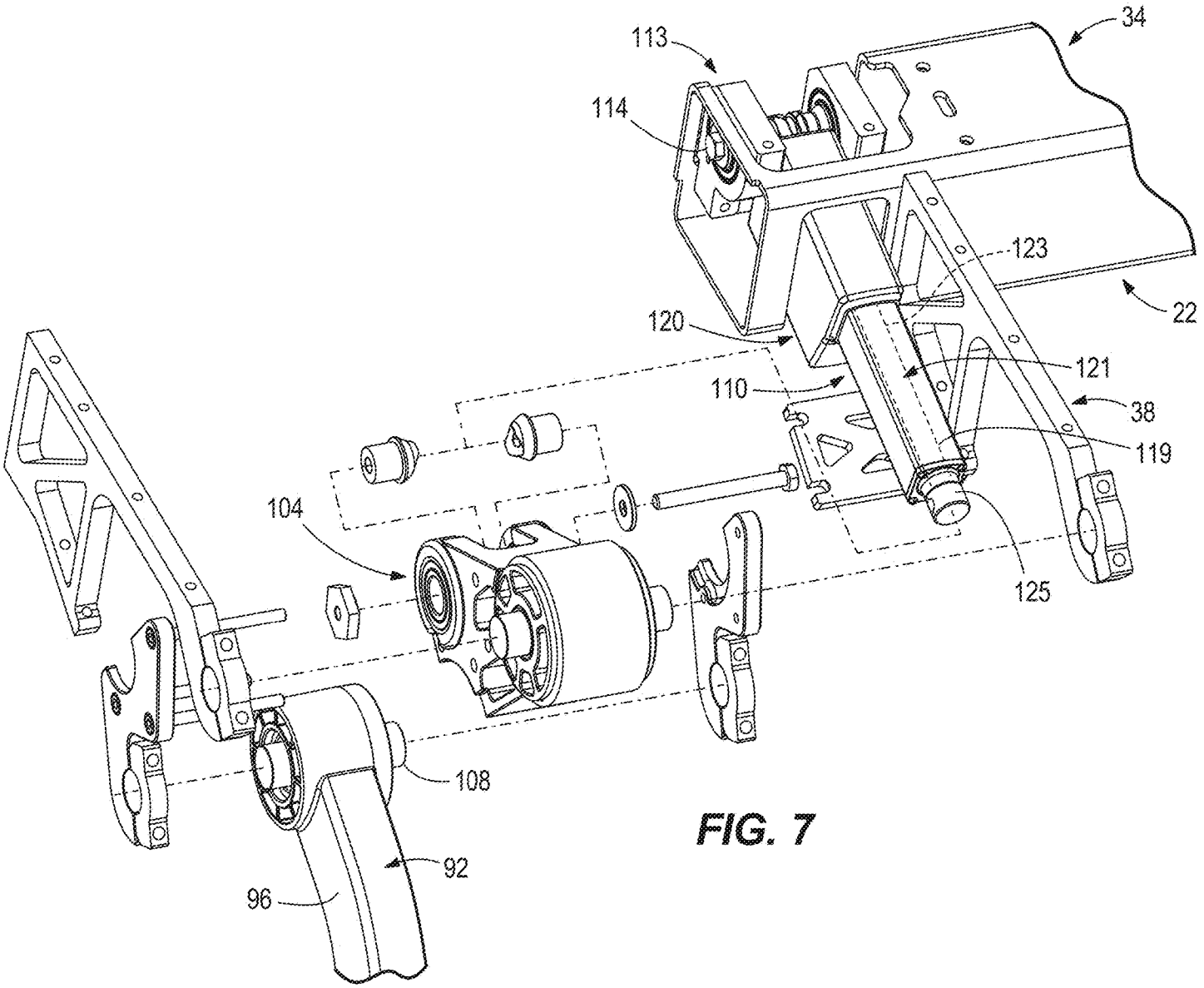
FIG. 7 is another exploded view of the portions illustrated in FIG. 6.

FIGS. 1-5 illustrate personal exercise machine 20 for performing a striding exercise motion. The machine 20 extends from front to back in a longitudinal direction L, from top to bottom in a vertical direction V, and from side to opposite side in a horizontal direction H. The machine 20 is generally symmetrical in the horizontal direction H, so that the components on one side of the machine 20 are the same as or are mirror images of the components on the opposite side of the machine 20. As such, the descriptions provided below regarding components on one side of the machine 20 equally apply to the components on the opposite side of the machine 20.

The machine 20 has a frame 22 including a longitudinally extending base member 24. Horizontally extending stabilizer members 26 extend from the front and rear of the base member 24 and prevent the machine 20 from tipping over in the horizontal direction H. Each stabilizer member 26 has feet 28 for supporting the frame 22 above the ground. The frame 22 has a forward support column 30 which extends vertically upwardly from the front of the base member 24. An angular gusset 32 braces and supports the forward support column 30 relative to the base member 24. A bridge 34 is mounted on top of the forward support column 30. The bridge 34 has a horizontally extending body 36 with opposing first and second arms 38 extending rearwardly therefrom. As such, the bridge 34 generally has a U-shape and defines an "activity zone" between the arms 38 for the user's body and/or arms during performance of the striding exercise motion. A generally trapezoidal-shaped stationary handlebar 42 is rigidly mounted on the body 36 between the arms 38 and is for manually grasping by a user operating the machine 20.

A user console 44 is mounted to and extends generally upwardly from the bridge 34. The console 44 includes a display screen 46 oriented towards the user operating the machine 20. As conventional, the console 44 can include a processor and memory and be configured for controlling various devices associated with the machine 20, including for control of resistance and/or incline as for example will be further described herein below. The display screen 46 optionally can be a touch screen wherein the user operating the machine 20 can manually touch the screen to input commands to the console 44 for controlling the machine 20. Optionally, input buttons 48 are located on the stationary handlebar 42 and are for manually inputting commands to the console 44. Optionally, input buttons can be located elsewhere such as on the upper ends of handgrips 127, described herein below. Input commands entered via the display screen 46 and/or input buttons 48 can for example include an increase or decrease in resistance of the machine 20 and/or increase or decrease in incline of the machine 20, and/or the like. Optionally biomechanical sensors 45 can be provided on the stationary handlebar 42 and/or on handgrips 127 for sensing heart rate of the user when the user manually grasps the handlebar 42 and/or on hand grips 127.

At the rear of the machine 20, the frame 22 further includes a rear support column 50 which extends angularly upwardly and rearwardly from the rear of the base member 24. A resistance mechanism 52 is mounted to the rear support column 50, including for example via a rear frame plate (not illustrated in FIG. 4) mounted to the rear support column 50 and/or the base member 24. The type and configuration of the resistance mechanism 52 is conventional and can vary from what is illustrated and described. In the illustrated example the resistance mechanism 52 is a hybrid generator-brake configured to provide a resistance to a striding motion performed on the machine 20, as will be further described herein below, and also configured to generate power based upon the striding motion, for example for powering the console 44. A suitable resistance mechanism is the "FB Six Series" sold by Chi Hua. The resistance mechanism 52 is connected to a pulley wheel 56 by a belt 58 and is configured so that rotation of the pulley wheel 56 rotates the resistance mechanism 52. The pulley wheel 56 is connected to the rear support column 50 by a center shaft 60 (see FIG. 8). The pulley wheel 56 and center shaft 60 are fixed relative to each other such that these components rotate together.

At the rear of the machine 20, radially opposed crank arms 62 have radially inner ends keyed to (fixed to) the center shaft 60 so that the crank arms 62 remain radially opposed to each other (i.e., 180 degrees apart) and so that rotation of the crank arms 62 and center shaft 60 causes rotation of the pulley wheel 56 about a pulley wheel pivot axis 64 defined by the center shaft 60. Rotation of the pulley wheel 56 is resisted by the resistance mechanism 52 via an electro magnet 66, as is conventional and well known in the art.

The machine 20 further has first and second pedal members 68 centrally located on opposite sides of the frame 22. The pedal members 68 are elongated in the longitudinal direction L, each having a central portion 70, a front portion 72 which extends generally forwardly and upwardly from the central portion 70, and a rear portion 74 which extends generally rearwardly and upwardly from the central portion 70 to a tail portion 76 which extends rearwardly from the rear portion 74 and generally but not necessarily parallel to the central portion 70.

At the rear of the machine 20, first and second elongated stride links 78 are freely rotatably (pivotably) coupled to the radially outer ends of the opposed crank arms 62, by for example bearings, at a stride link-crank arm pivot axis 80. Each stride link 78 has a first end which is pivotably coupled to a respective tail portion 76 of a pedal member 68 at a stride link-pedal member pivot axis 82. Each stride link 78 has an opposite, second end which is pivotably coupled to a distal or rear end of an elongated idler link 84 at a stride link-idler link pivot axis 86. The opposite, proximal or front end of the idler link 84 is pivotably coupled to the base member 24 at an idler link-base member pivot axis 88. As illustrated in the figures, the stride link-crank arm pivot axis 80 is located along the stride link 78 between the stride link-pedal member pivot axis 82 and stride link-idler link pivot axis 86 and in particular is closer to the stride link-pedal member pivot axis 82 than to the stride link-idler link pivot axis 86. In other examples, the pivot axis 80 is at the center of the stride link 78 or closer to the pivot axis 86.

First and second foot pads 90 are supported on the central portions 70 of the first and second pedal members 68. The foot pads 90 are for supporting the user's feet during performance of the elliptical striding motion and travel along an elliptical path which is incline adjustable, as will be further described herein below.

The machine 20 further has first and second rocker arms 92 which are pivotably coupled to the frame 22 by an adjustment device 94, which will be further described herein below. The type and configuration of the adjustment device 94 can vary and additional examples are illustrated in the examples illustrated in FIGS. 11-20 and further described herein below. The rocker arms 92 have an upper end portion 96, a lower end portion 98, and an elbow portion 100 located between the upper end portion 96 and the lower end portion 98 so that the upper end portion 96 and lower end portion 98 extend at an angle relative to each other. The lower end portions 98 are pivotably coupled to the front portion 72 of the pedal members 68 at a rocker arm-pedal member pivot axis 102 so that the pedal members 68 are pivotably movable relative to the rocker arms 92 and also so that pivoting of the rocker arms 92 relative to the frame 22 causes commensurate pivoting and/or translating of the pedal members 68 relative to the frame 22, i.e., so that these components pivot and/or translate together relative to the frame 22.

Referring to FIGS. 3, 4, 6 and 7, the adjustment device 94 is located in the bridge 34 and extends into the noted arms 38 on both sides of the activity zone. The adjustment device 94 is specially configured to facilitate selective adjustment and setting of a position of the rocker arms 92 relative to the frame 22, respectively, specifically the position of pivot axis 108, which thereby changes an incline shape of elliptical paths of travel of the foot pads 90, respectively, during the striding exercise motion, as will be further described herein below. The adjustment device 94 can be controlled by the noted controller based upon a stored exercise program or based upon an input by the operator to the console 44. For example this can be controlled via touch screen, input buttons 48 on the stationary handlebar 42 and/or input buttons on the upper ends of hand grips 127. As will be evident from the illustrated examples and the following description, the type and configuration of the adjustment device 94 can vary.

In the first example illustrated in FIGS. 1-10, the adjustment device 94 includes first and second incline links 104 which pivotably couple the upper portion 96 of the rocker arms 92 to the frame 22. More specifically, the incline links 104 have an upper portion which is pivotably coupled to the frame 22 at an incline link-frame pivot axis 106. The incline links 104 further have a lower portion which is pivotably coupled to the upper end portion 96 of the rocker arm 92 at an incline link-rocker arm pivot axis 108 which is located generally below the incline link-frame pivot axis 106. Conventional bearings support the noted couplings so that the incline links 104 are pivotable relative to the noted axes 106, 108.

The adjustment device 94 is configured to pivot the first and second incline links 104 relative to the frame 22 (i.e., about the incline link-frame pivot axis 106) to thereby adjust and set the position of the rocker arms 92 relative to the frame 22, in particular to adjust and set the position of the incline link-rocker arm pivot axis 108 relative to the frame 22 (i.e., about the incline link-frame pivot axis 106). In the illustrated example, the adjustment device 94 includes first and second linear actuators 110. Note that the type of linear actuator 110 can vary from what is illustrated and described. In the illustrated example, the linear actuator 110 includes an electro-mechanical linear actuator, which has an electric gearmotor 120, a leadscrew assembly 121 and, a leadnut and tube assembly 125 (see FIGS. 6 and 7). The linear actuator 110 has a forward end pivotably coupled to the bridge 34 by a trunnion assembly 113, particularly at an actuator-bridge pivot axis 114. The linear actuator 110 has an opposite, rear end pivotably coupled to the incline link 104 at an actuator-incline link pivot axis 118 (see FIG. 6). A conventional bearing, which is best seen in exploded view in FIG. 7, supports the coupling at the actuator-incline link pivot axis 118. The actuator-incline link pivot axis 118 is offset forwardly relative to the incline link-frame pivot axis 106 and the incline link-rocker arm pivot axis 108. In the illustrated non-limiting example, the incline link 104 is a generally triangular plate member wherein the incline link-frame pivot axis 106, incline link-rocker arm pivot axis 108 and actuator-incline link pivot axis 118 are located at the respective three apexes of the triangular shape.

The gearmotor 120, leadscrew assembly 121, and leadnut and tube assembly 125 are configured to lengthen or shorten the linear actuator 110 upon an input command from the noted controller, which can be based upon an operator input to the console 44 or based upon a program in the noted controller, as described herein above. Operation of the gearmotor 120 in a first direction rotates the lead screw 123 of the leadscrew assembly 121 in the first direction which causes the leadnut and tube assembly 125 to travel outwardly along the leadscrew 123 and outwardly relative to the housing 119 of linear actuator 110, thus lengthening the linear actuator 110. Operation of the gearmotor 120 in an opposite, second direction oppositely rotates the lead screw 123 in the second direction which cause the leadnut and tube assembly 125 to retract inwardly relative to the housing 119, thus shortening the linear actuator 110. Due to the relative locations of the incline link-frame pivot axis 106, incline link-rocker arm pivot axis 108, actuator-bridge pivot axis 114, and actuator-incline link pivot axis 118, extension of the linear actuator 110 pivots the incline link 104 rearwardly along an arc relative to the bridge 34, which moves the incline link-rocker arm pivot axis 108 rearwardly relative to the frame 22, along an arc relative to the incline link-frame pivot axis 106. As illustrated and described herein below, this increases or raises the incline of the elliptical path of the foot pads 90 during the striding motion. Conversely, shortening the linear actuator 110 pivots the incline link 104 forwardly along the arc relative to the bridge 34, along an arc relative to the incline link-frame pivot axis 106. This moves the incline link-rocker arm pivot axis 108 forwardly along the arc relative to the frame 22. As illustrated and described herein below, this reduces or lowers the incline of the elliptical path of the foot pads 90 during the striding motion.

It is important to note that the adjustment device 94 does not need to include two actuators, as shown in the first example. In other examples, a single adjustment device connected to both of the incline links 104 is employed, via for example an electric motor, worm gears, pulleys, and/or any other conventional mechanism for causing the above-noted adjustment of the relative position of the axes. Additional examples are illustrated in FIGS. 11-20, which will be described herein below.

Referring to FIGS. 1-5, the machine 20 has movable handle members 122 which are pivotably coupled to opposite sides of the bridge 34 at a handle member-bridge pivot axis 124. Each handle member 122 has an upper end with a hand grip 127 for manually grasping by the user performing the striding exercise motion. Each handle member 122 has a lower end which is pivotably coupled to a coupler link 126 at a handle member-coupler link pivot axis 128. Thus, the handle member 122 and respective coupler link 126 pivot together about the handle member-bridge pivot axis 124 and the coupler link 126 is pivotable relative to the handle member 122 about the handle member-coupler link pivot axis 128. Each coupler link 126 has a forward end portion 130 coupled to the handle member 122 at the handle member-coupler link pivot axis 128 and a rearward end portion 132 pivotably coupled to the central portion 70 of the pedal member 68 at a coupler link-pedal member pivot axis 134. Thus the coupler link 126 is pivotable relative to the pedal member 68 about the coupler link-pedal member pivot axis 134. An elbow portion 136 is located between the forward and rearward end portions 130, 132 so that the forward end portion 130 extends angularly upwardly relative to the rearward end portion 132. As such, the user standing on the foot pads 90 and manually grasping the hand grips 127 can alternately push and pull on the hand grips 127 to thereby apply pushing and pulling forces on the pedal members 68 via the coupler links 126, which assists the striding exercise motion, as will be further described herein below.

Figure 8:
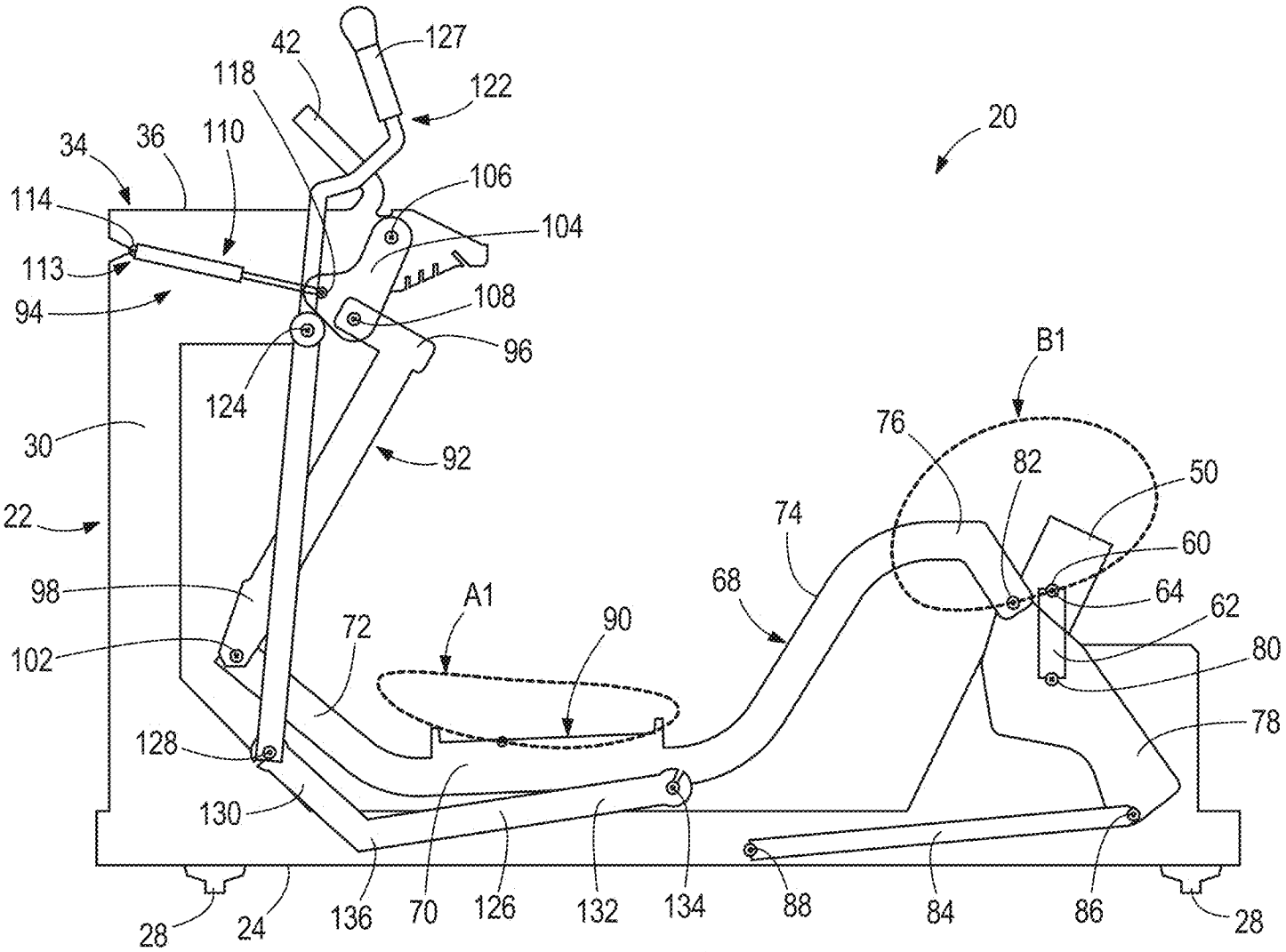
FIG. 8 is a schematic view showing a low incline elliptical path of travel of foot pads on the machine.
Figure 9:
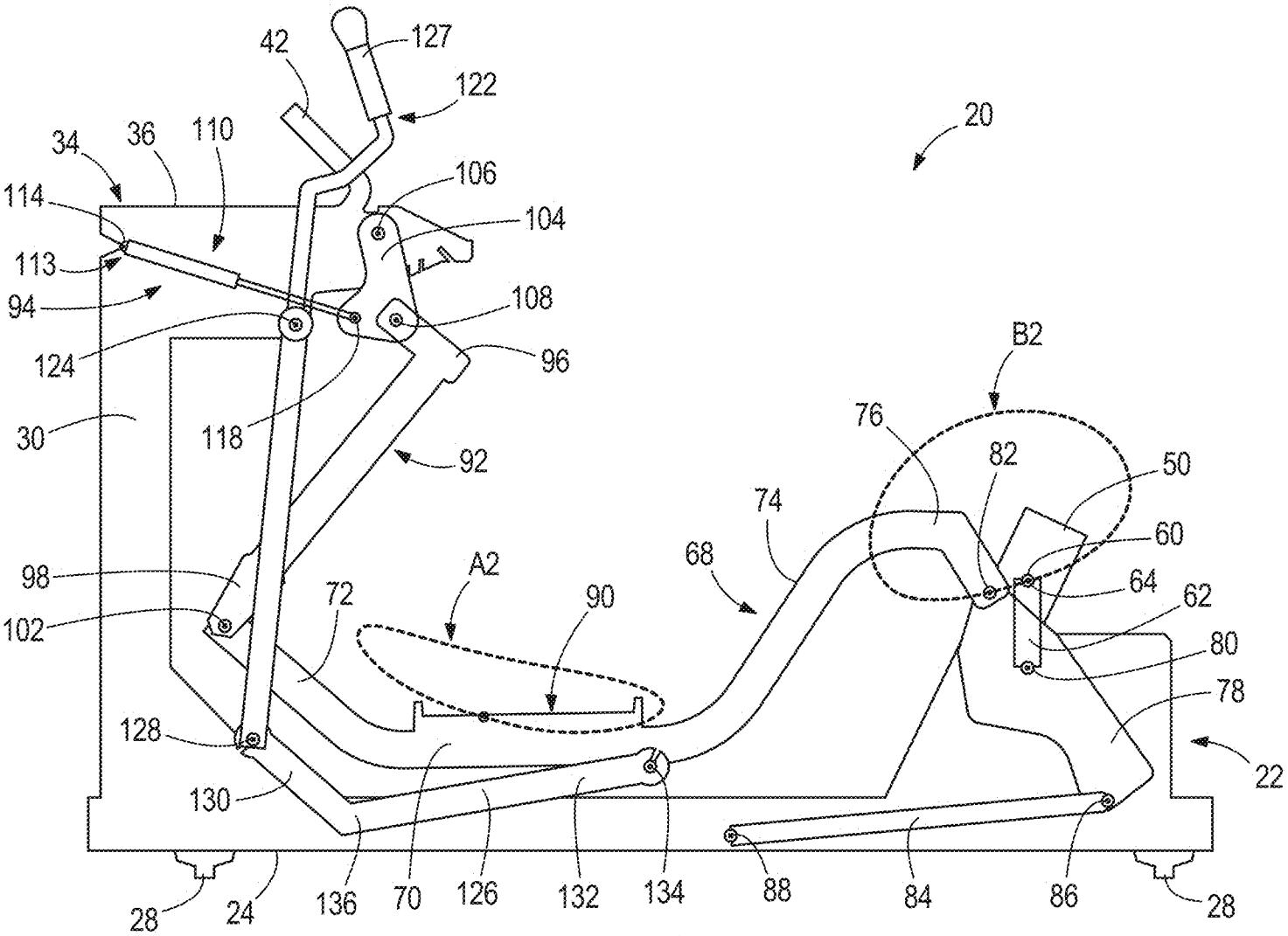
FIG. 9 is a schematic view showing a medium incline elliptical path of travel of foot pads on the machine.
Figure 10:
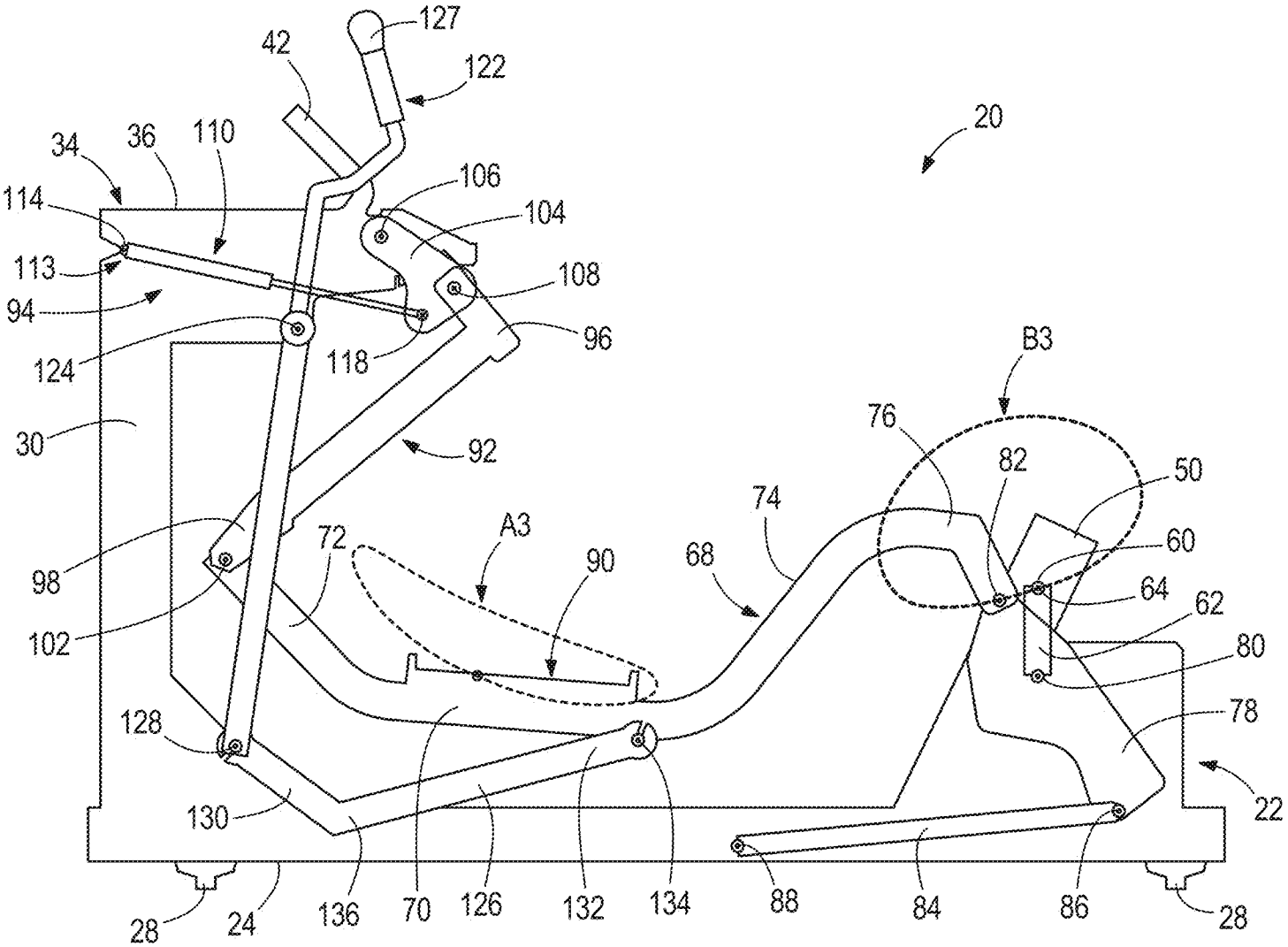
FIG. 10 is a schematic view showing a high incline elliptical path of travel of foot pads on the machine.

FIGS. 8-10 are schematic views of the machine 20 showing the paths of travel A1-A3 of the foot pads 90 and the paths of travel B1-B3 of the stride link-pedal member pivot axis 82 during low incline (FIG. 8), medium incline (FIG. 9), and high incline (FIG. 10). In each figure, the rocker arms 92 have a different position of swing range, which is determined by position of the adjustment device 94. FIG. 8 illustrates low-incline, where the linear actuators 110 are retracted and thus the incline links 104 are pivoted about the incline link-frame pivot axis 106 towards the bridge 34 (i.e., clockwise about the incline link-frame pivot axis 106 in the side view illustrated in FIG. 8). This moves the incline link-rocker arm pivot axis 108 along an arc towards the bridge 34 and via connection of the rocker arms 92 and pedal members 68, positions the foot pads 90 so as to follow the low-incline elliptical path of travel A1. FIG. 9 illustrates medium-incline, wherein the linear actuators 110 are moderately extended and thus the incline links 104 are pivoted about the incline link-frame pivot axis 106 away from the bridge 34 (i.e., counter-clockwise about the incline link-frame pivot axis 106 from the side view illustrated in FIG. 9). This moves the incline link-rocker arm pivot axis 108 along an arc away from the bridge 34 and via connection of the rocker arms 92 and pedal members 68, positions the foot pads 90 to follow the medium-incline elliptical path of travel A2. FIG. 10 illustrates a high incline-situation, wherein the linear actuators 110 are further extended and thus the incline links 104 are pivoted about the incline link-frame pivot axis 106 away from the bridge 34 (i.e., further counter-clockwise about the incline link-frame pivot axis 106 from the side view illustrated in FIG. 10). This moves the incline link-rocker arm pivot axis 108 along the arc further away from the bridge 34 and via connection of the rocker arms 92 and pedal members 68, positions the foot pads 90 to follow the high-incline elliptical path of travel A3. It is important to understand that the three positions illustrated in FIGS. 8-10 are exemplary and other positions are possible via operation of the adjustment device 94, which can be automatically controlled by programming of the console 44 and/or by inputs to the console 44 and/or input buttons 48 and/or other input buttons such as on the upper ends of handgrips 127.

By comparison of FIGS. 8-10, it can be seen that the machine 20 is advantageously configured to maintain a substantially compact and constant length (in the length direction L) of the paths of travel A1-A3 throughout the adjustments made by the adjustment device 94. The configurations of the various components advantageously take up a relatively small footprint. The ends of the rocker arms 92 advantageously do not swing beyond the front of the frame 22, thus maintaining a small footprint. The paths of travel B1-B3 are also substantially constant, due to the configuration of the stride link configuration illustrated and described herein above. The rear linkage including the stride links 78 advantageously does not swing beyond the rear portion of the frame 22, thus maintaining a small footprint. The configuration of the movable handle members 122 and the coupler link 126 is advantageous in that the overall path of movement (i.e., swing range of the handle members 122 about the handle member-bridge pivot axis 124) is substantially constant despite changes in incline via the adjustment device 94.

Advantageously, the foot pads 90 are located on the pedal members 68 at a distance rearward of the rocker arm-pedal member pivot axis 102 to create a more natural, vertical height of the paths of travel A1-A3. This feature in combination with the path of travel B1-B3 yields a more natural, and smooth path of travel A1-A3 in all incline settings. Also, the path of travel (arc) along which the incline link travels, as described herein above, is tilted upward towards the rear portion of travel, towards high incline. This tailors/blends some additional vertical height to the overall ellipse height as it adjusts to a high incline setting.

Figure 11:
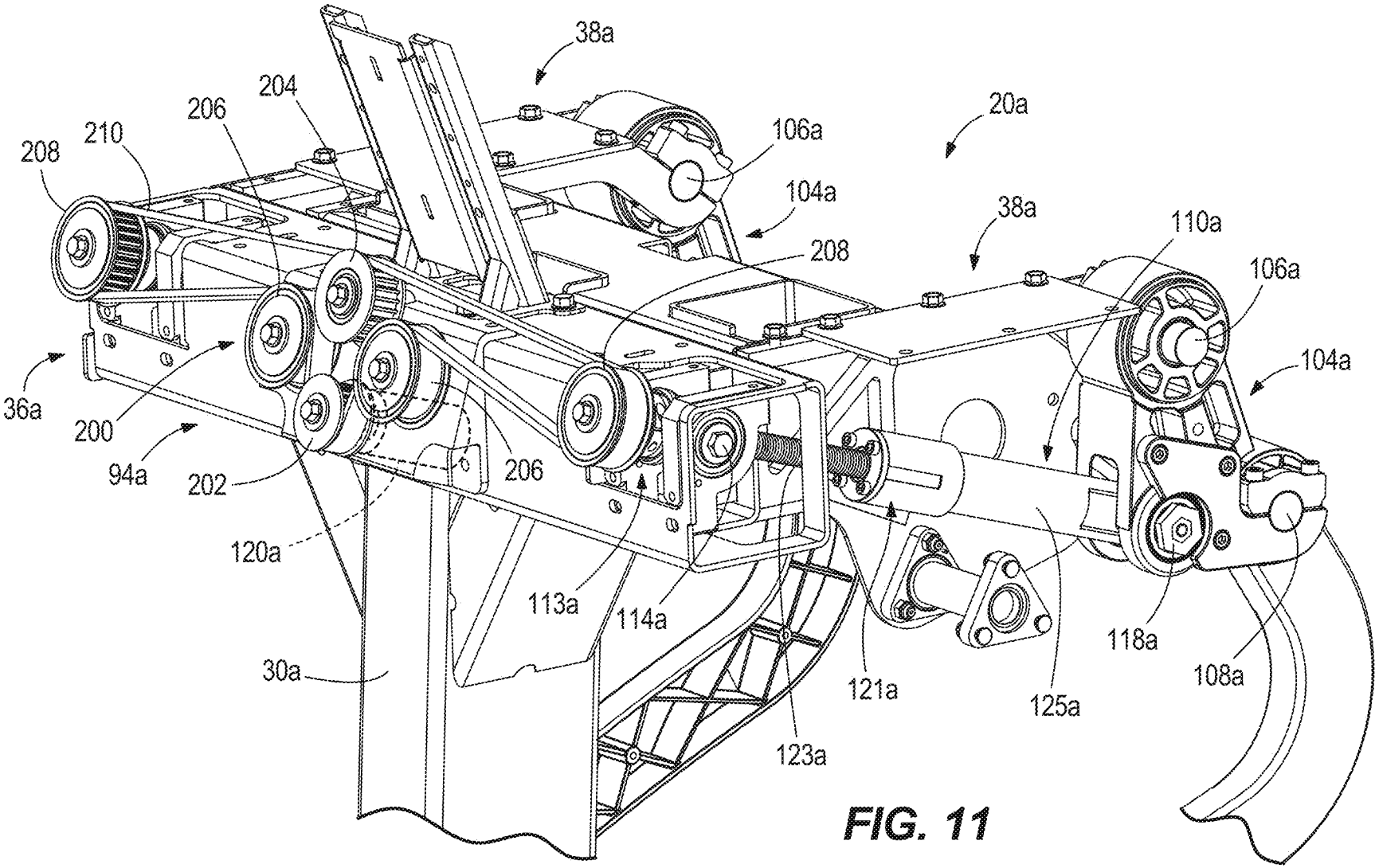
FIG. 11 is a front perspective view looking down at a second non-limiting example of an exercise machine according to the present disclosure.
Figure 12:
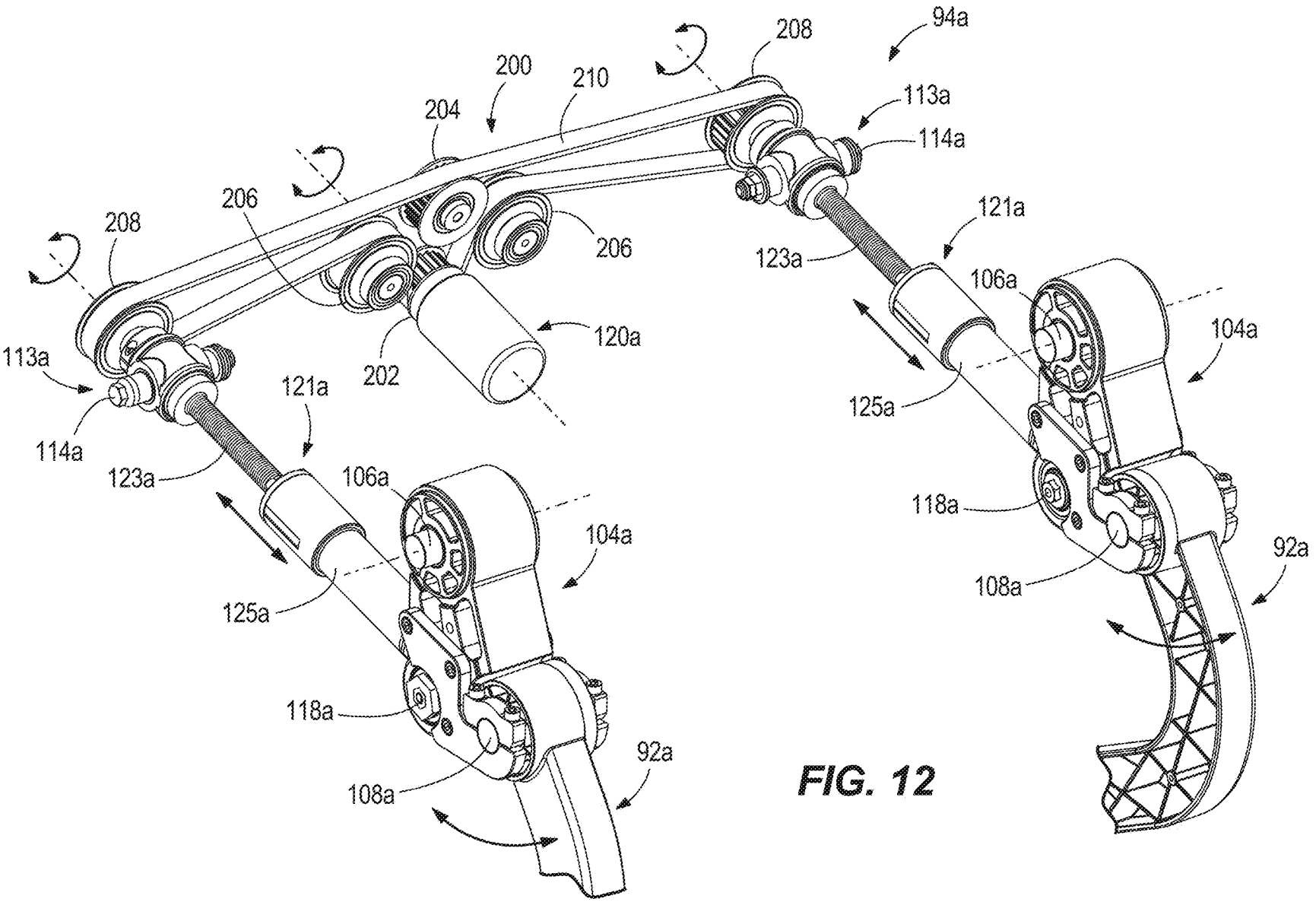
FIG. 12 is a rear perspective view looking down at the adjustment device of the second example.

FIGS. 11-12 illustrate a second example of an exercise machine 20*a*. The figures only show aspects of the bridge 34*a* of the machine 20*a*. It should be understood that in a non-limiting example, the remainder of the machine 20*a* is configured the same as the machine 20 shown in FIGS. 1-7 and described herein above. Like features are designated with like reference numbers having an "a" designation.

Similar to the first example, the machine 20*a* has a forward support column 30*a* and a bridge 34*a*, which is mounted on top of the forward support column 30*a* and has a horizontally extending body 36*a* with opposing first and second arms 38*a* extending rearwardly therefrom. The machine 20*a* has an adjustment device 94*a* which is located on the bridge 34*a* and extends into the noted 38*a* on both sides of the activity zone. The adjustment device 94*a* is specially configured to facilitate selective adjustment and setting of a position of the rocker arms 92*a* relative to the frame 22*a*, respectively, which thereby changes an incline shape of the elliptical paths of travel, as described herein above regarding the first example. Just like the first example, the adjustment device 94*a* can be controlled by the noted controller based upon a stored exercise program or based upon an input by the operator.

Similar to the first example, the adjustment device 94*a* is configured to pivot first and second incline links 104*a* relative to the frame (i.e., about the incline link-frame pivot axis 106*a*) to thereby adjust and set the position of the rocker arms 92*a* relative to the frame 22*a*, in particular to adjust and set the position of the incline link-rocker arm pivot axis 108*a* relative to the frame 22*a* (i.e., about the incline link-frame pivot axis 106*a*). In the illustrated example, the adjustment device 94*a* includes first and second lead screw assemblies 121*a* which are rotary devices having a forward end pivotably coupled to the bridge 34*a* by a trunnion assembly 113*a*, particularly at an actuator-bridge pivot axis 114*a*. The adjustment device 94*a* further includes first and second lead nut and tube assemblies 125*a* each having an opposite, rear end pivotably coupled to the incline link 104*a* at an actuator-incline link pivot axis 118*a*. Similar to the first example, the actuator-incline link pivot axis 118*a* is offset forwardly relative to the incline link-frame pivot axis 106*a* and the incline link-rocker arm pivot axis 108*a*.

The adjustment device 94*a* also has an actuator, which in the illustrated example is an electric gearmotor 120*a* mounted to the forward portion of the bridge 34*a* and a pulley assembly 200. The gearmotor 120*a* has an output shaft which is rotatably engaged with the pulley assembly 200. The configuration of the pulley assembly 200 can vary from what is shown as long as it is configured such that operation of the gearmotor 120*a* actuates the first and second lead screw assemblies 121*a*, as described hereinbelow. In the illustrated example, the pulley assembly 200 comprises a driving pulley wheel 202 which is coupled to and rotates with the output shaft of the gearmotor 120*a*, a center idler pulley wheel 204 which is rotatably mounted to the bridge 34*a* along a forward portion of the body 36*a*, above the driving pulley wheel 202, a pair of side idler pulley wheels 206 located between and on opposite sides of the driving pulley wheel 202 and center idler pulley wheel 204, and driven pulley wheels 208 which are coupled to and rotate the respective lead screws 123*a* of the lead screw assemblies 121*a*. The pulley assembly 200 further comprises a belt 210 wound around the driving pulley wheel 202, the main idler pulley wheel 204, the side idler pulley wheels 206, and the driven pulley wheels 208, as shown, such that rotation of the driving pulley wheel 202 by the gearmotor 120*a* causes rotation of the rest of the pulley wheels. Rotation of the driving pulley wheel 202 by the gearmotor 120*a*, which as explained herein above is controlled by the noted controller, thus causes corresponding rotation of the driven pulley wheels 208, which in turn rotates and causes extension or retraction of the leadnut and tube assemblies 125*a* along the lead screws 123*a*. Thus, as will be understood from the above descriptions by one having ordinary skill in the art, operation of the gearmotor 120*a* in a first direction rotates the lead screws 123*a* which causes the leadnut and tube assemblies 125*a* to travel outwardly relative to the lead screws 123*a* and housings (not shown) of the linear actuators 110*a* (see, e.g., the housing 119 of FIGS. 6 and 7), thus lengthening the linear actuator 110*a*, increasing the distance between axes 114*a* and 118*a*. Operation of the gearmotor 120 in an opposite, second direction oppositely rotates the lead screw 123*a* in the second direction which cause the leadnut and tube assemblies 125*a* to retract inwardly along the lead screws 123*a*, relative to the lead screw and housing of the linear actuator 110*a*, thus shortening the linear actuator 110*a*, decreasing the distance between axes 114*a* and 118*a*. Similar to the first example, due to the relative locations of the incline link-frame pivot axis 106*a*, incline link-rocker arm pivot axis 108*a*, actuator-bridge pivot axis 114*a*, and actuator-incline link pivot axis 118*a*, extension of the leadnut and tube assembly 125*a* pivots the incline link 104*a* rearwardly along an arc relative to the bridge 34*a*, which moves the incline link-rocker arm pivot axis 108*a* rearwardly relative to the frame 22*a*, along an arc relative to the incline link-frame pivot axis 106*a* shown by arrows in FIG. 12. As described herein above, this increases or raises the incline of the elliptical path of the foot pads 90 during the striding motion. Conversely, retracting the leadnut and tube assembly 125*a* pivots the incline link 104*a* forwardly along the arc relative to the bridge 34*a*, along an arc relative to the incline link-frame pivot axis 106*a*. This moves the incline link-rocker arm pivot axis 108*a* forwardly along the arc relative to the frame 22*a*. As illustrated and described herein below, this reduces or lowers the incline of the elliptical path of the foot pads 90*a* during the striding motion.

Figure 13:
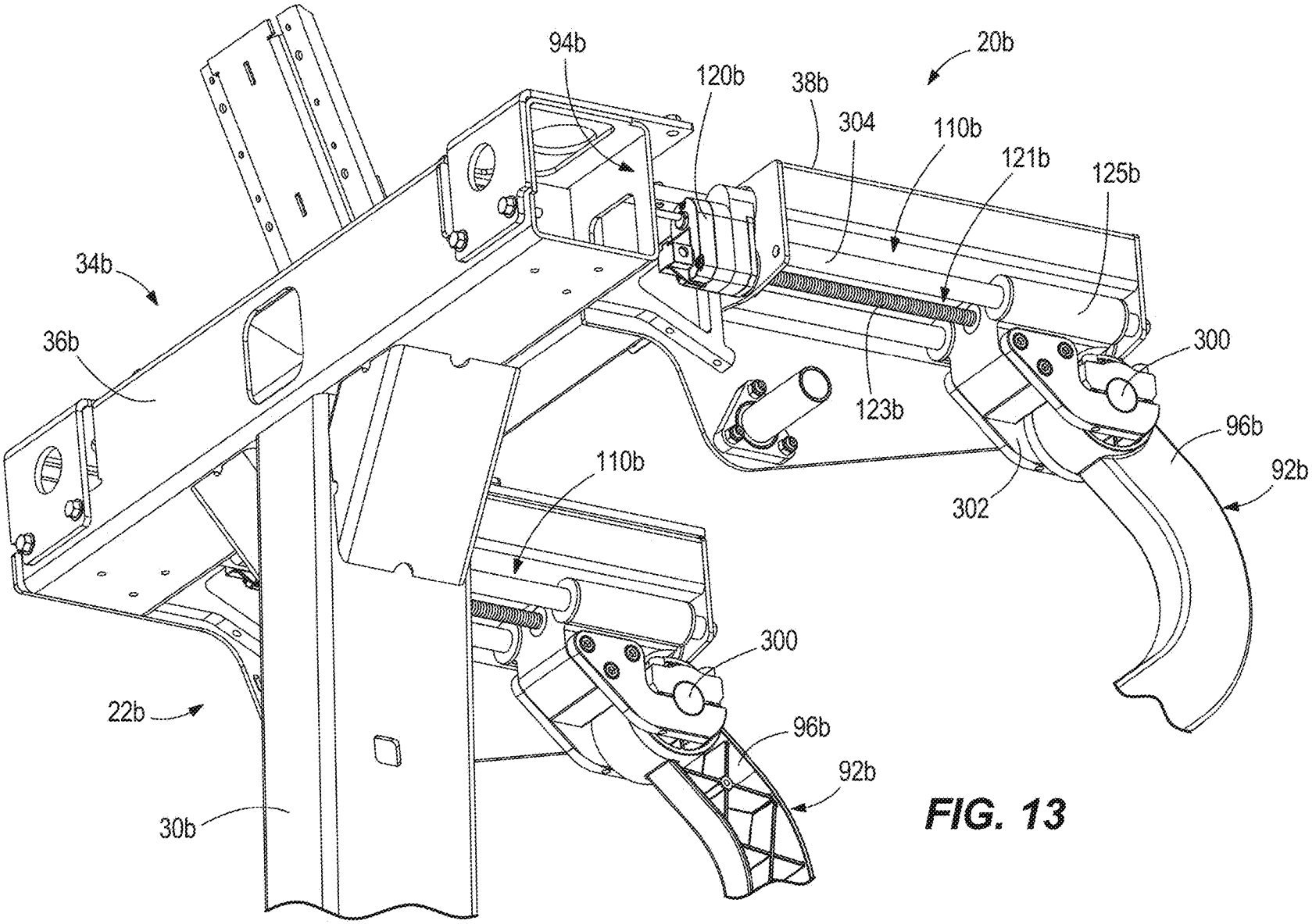
FIG. 13 is a front perspective view looking up at a third non-limiting example of an exercise machine according to the present disclosure.
Figure 14:
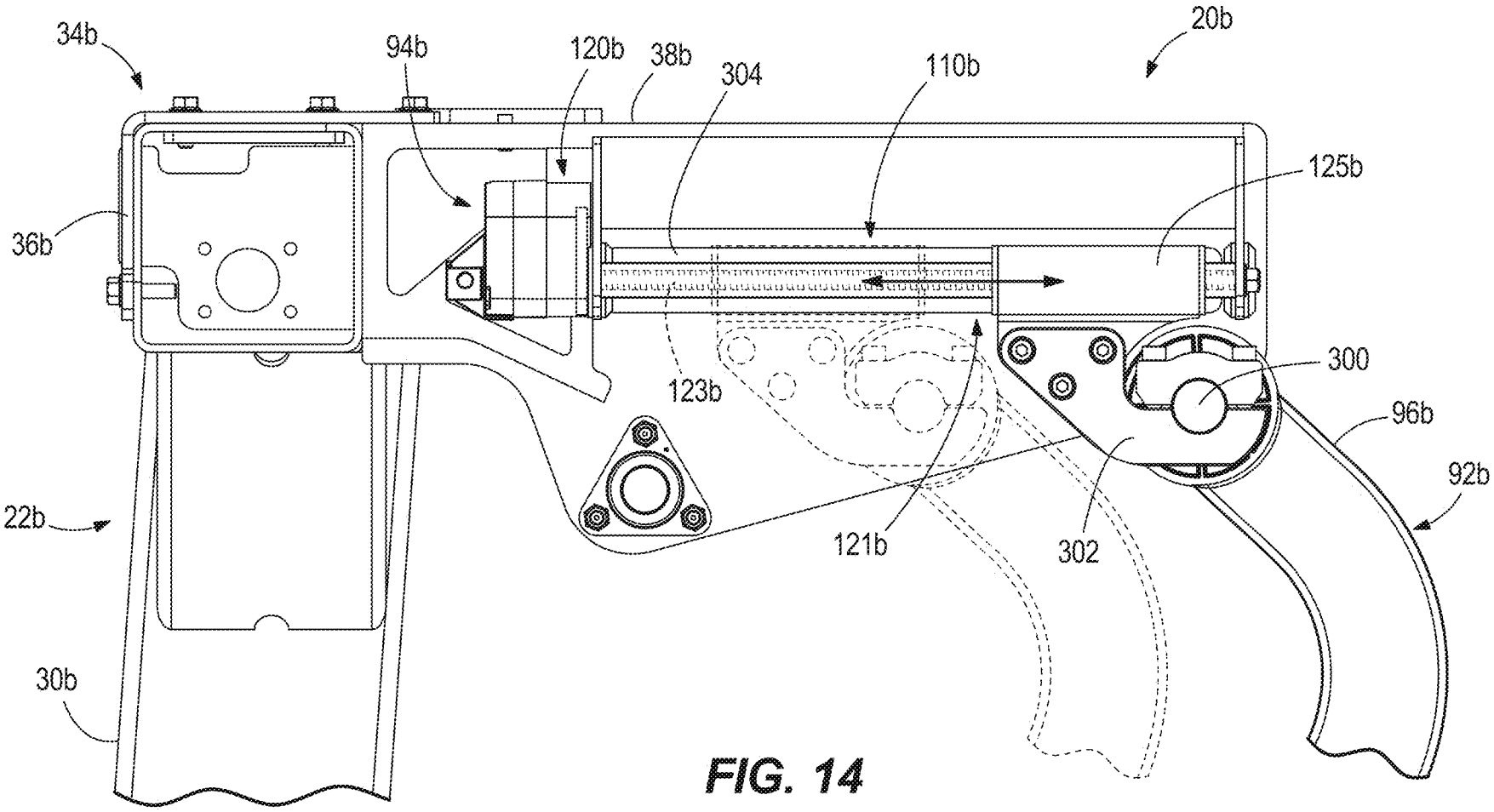
FIG. 14 is a side sectional view of the third example.

FIGS. 13 and 14 illustrate a third example of an exercise machine 20*b*. The figures only show aspects of the bridge 34*b* of the machine 20*b*. It should be understood that in a non-limiting example, the remainder of the machine 20*b* is configured the same as the machine 20 shown in FIGS. 1-7 and described herein above. Like features are designated with like reference numbers having a "b" designation.

Similar to the first and second examples, the machine 20*b* has a forward support column 30*b* and the bridge 34*b*, which is mounted on top of the forward support column 30*b* and has a horizontally extending body 36*b* with opposing first and second arms 38*b* extending rearwardly therefrom. The machine 20*b* has an adjustment device 94*b* located in the bridge 34*b* and extending into the noted arms 38*b* on both sides of the activity zone. The adjustment device 94*b* is specially configured to facilitate selective adjustment and setting of a position of the rocker arms 92*b* relative to the frame 22*b*, respectively, which thereby changes an incline shape of elliptical paths of travel of the foot pads 90, respectively, during the striding exercise motion, as will be further described herein below. The adjustment device 94*b* can be controlled by the noted controller based upon a stored exercise program or based upon an input by the operator to the console 44.

Unlike the first and second examples described above, the adjustment device 94*b* does not include first and second incline links for pivotably coupling the rocker arms 92*b* to the frame 22*b*. The adjustment device 94*b* is not configured to pivot first and second incline links relative to the frame (i.e., about the incline link-frame pivot axis 106*a*). In contrast, the adjustment device 94*b* includes first and second linear actuators 110*b*, which in the illustrated example include an electro-mechanical linear actuator having an electric gearmotor 120*b*, a leadscrew assembly 121*b* having a forward end fixedly coupled to the bridge 34*b*, and a leadnut and tube assembly 125*b* having an opposite, rear end pivotably coupled to the upper portion of the rocker arm 92*b* at an adjustment device-rocker arm pivot axis 300.

The gearmotor 120*b*, leadscrew assembly 121*b*, and leadnut and tube assembly 125*b* are configured to lengthen or shorten the linear actuator 110*b* upon an input command from the noted controller, which can be based upon an operator input to the console 44 or based upon a program in the noted controller. Operation of the gearmotor 120*b* in a first direction rotates the lead screw 123*b* of the leadscrew assembly 121*b* in the first direction which causes the leadnut and tube assembly 125*b* to travel outwardly relative to the leadscrew assembly 121*b*, thus lengthening the linear actuator 110*b*. Operation of the gearmotor 120*b* in an opposite, second direction oppositely rotates the lead screw 123*b* in the second direction which causes the leadnut and tube assembly 125*b* to retract inwardly relative to the lead screw assembly 121*b*, thus shortening the linear actuator 110*b*. The upper portion 96*b* of the rocker arm 92*b* is coupled to the leadnut and tube assembly 125*b* by a carriage 302. The carriage 302 slides along and is supported by a pair of guides 304, which are shafts rigidly mounted to the arms 38*b* of the bridge 34*b*. Each shaft has a smooth outer surface along which the carriage 302 slides as the lead screw 123*b* rotates. Thus it will be understood that extension of the linear actuator 110*b* linearly moves the upper portion 96*b* of the rocker arm 92*b* rearwardly, thus moving the adjustment device-rocker arm pivot axis 300 rearwardly relative to the frame 22*b*. This increases or raises the incline of the elliptical path of the foot pads 90 during the striding motion. Retraction of the linear actuator 110*b* linearly moves the upper portion of the rocker arm 92*b* forwardly, thus moving the adjustment device-rocker arm pivot axis 300 forwardly relative to the frame 22*b*. This reduces or lowers the incline of the elliptical path of the foot pads 90 during the striding motion. Unlike the previous examples, the motion of the adjustment device-rocker arm pivot axis 300 provided by the linear actuators 110*b* is straight linear, rather than along an arc.

Figure 15:
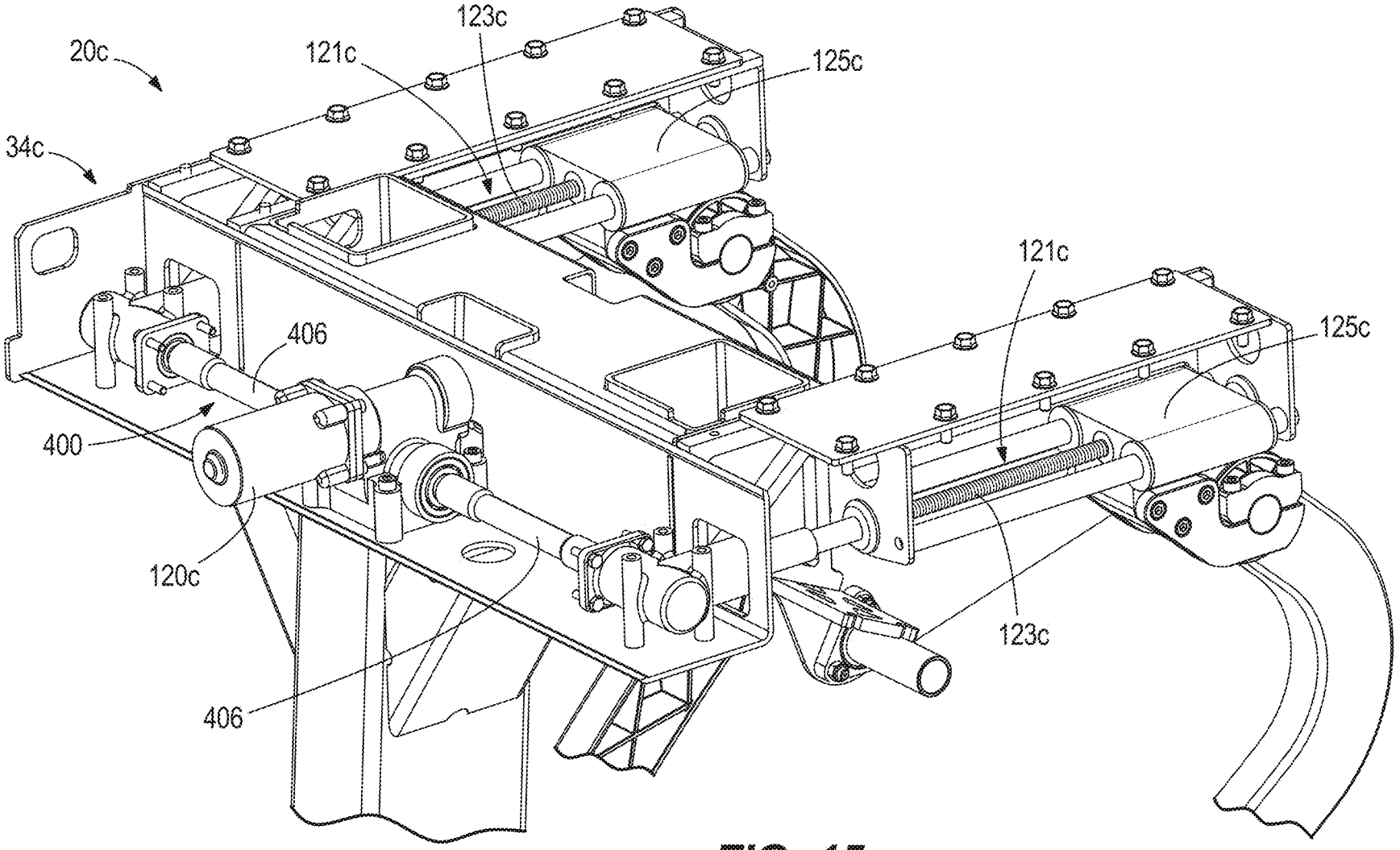
FIG. 15 is a front perspective view looking down at a fourth non-limiting example of an exercise machine according to the present disclosure.
Figure 16:
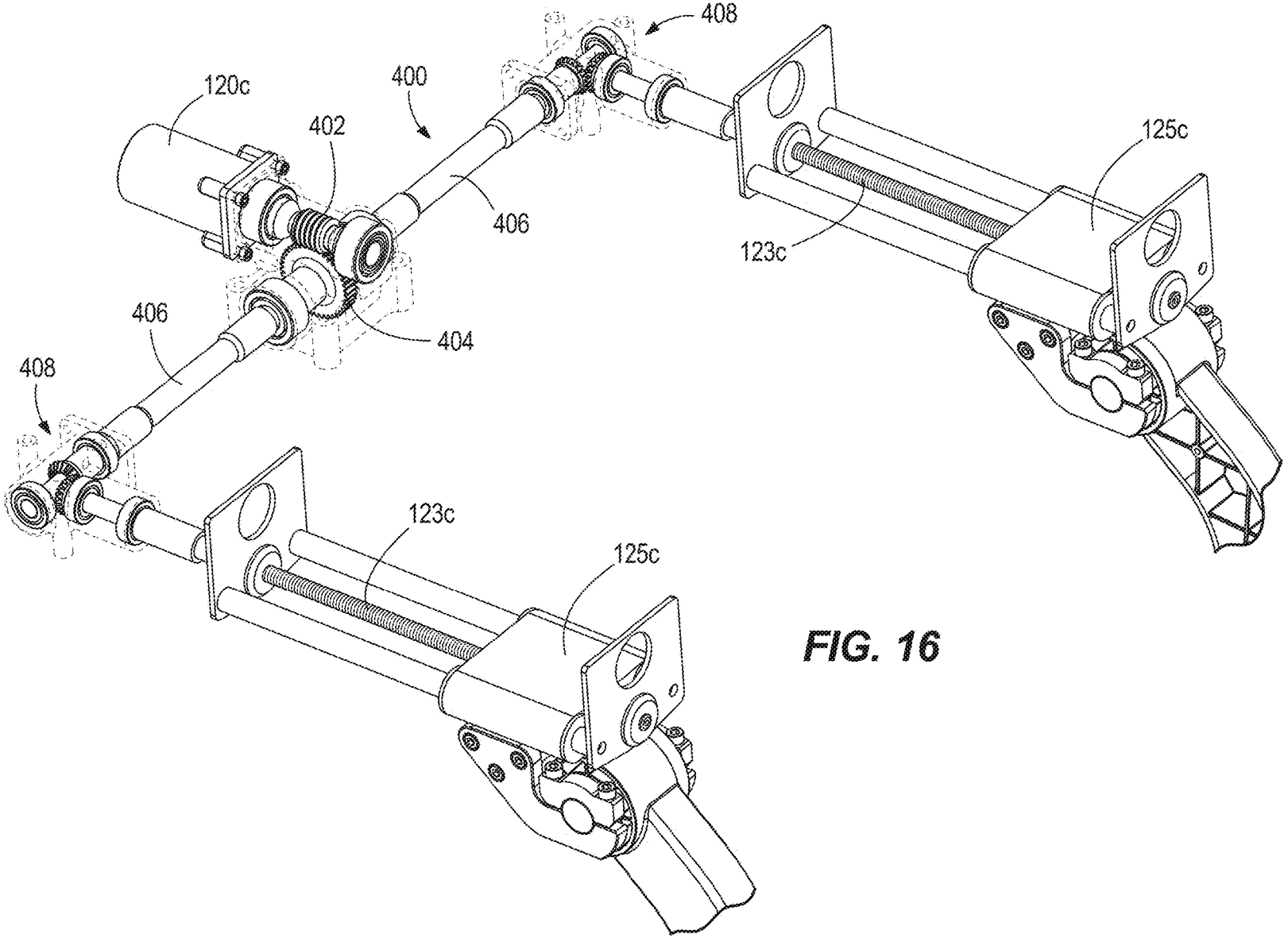
FIG. 16 is a rear perspective view looking down at the adjustment device of the fourth example.
Figure 17:
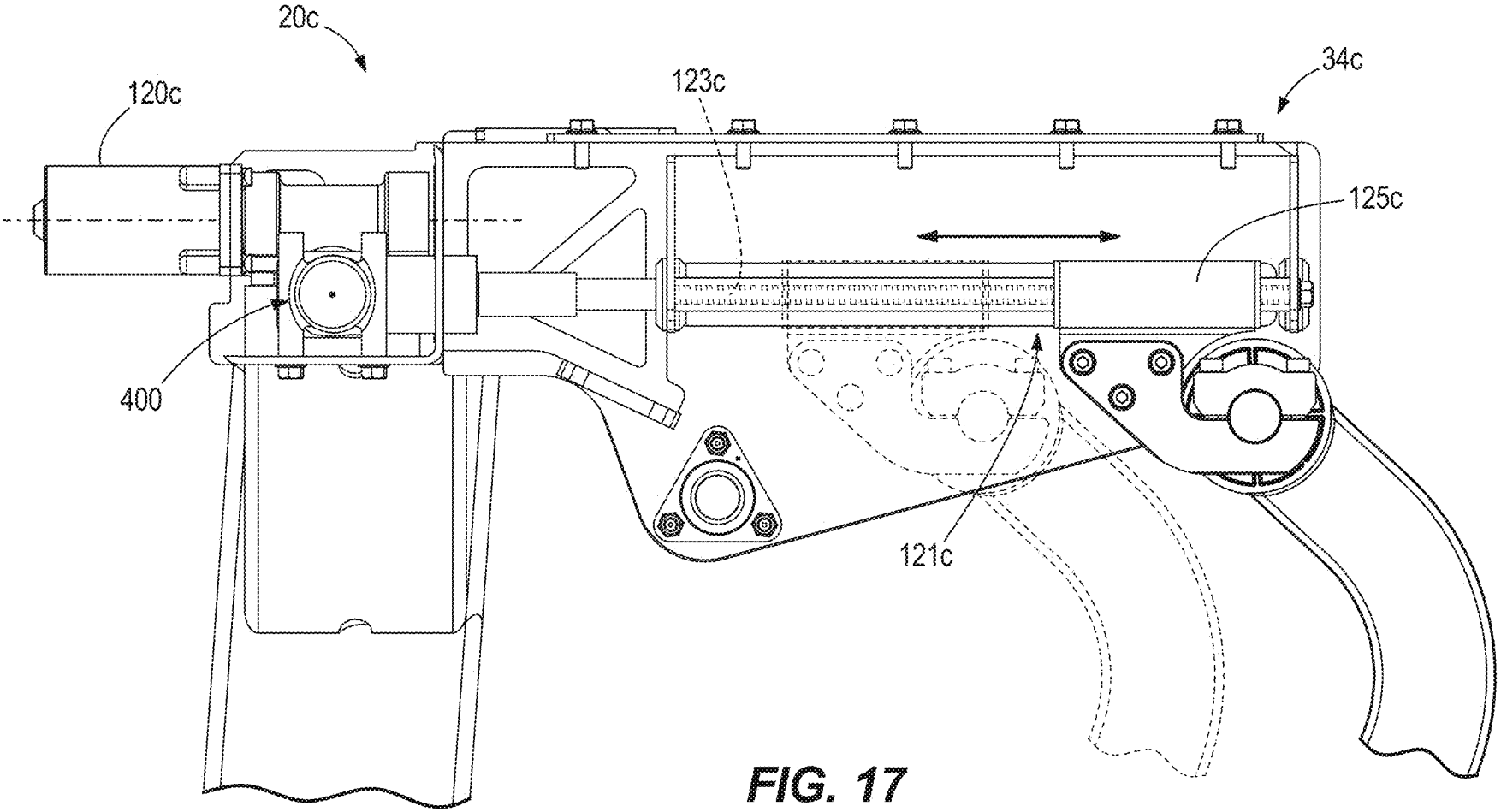
FIG. 17 is a side sectional view of the fourth example.

FIGS. 15-17 illustrate a fourth example of an exercise machine 20*c*. The figures only show aspects of the bridge 34*c* of the machine 20*c*. It should be understood that in a non-limiting example, the remainder of the machine 20*c* is configured the same as the machine 20 shown in FIGS. 1-7 and described herein above. Like features are designated with like reference numbers having a "c" designation.

As can be seen from the drawings, the fourth example is like the third example, except the electric gearmotor 120*c* is not located within the arms 38*c* of the bridge 34*c*, but instead is mounted to the front portion of the body 36*c* of the bridge 34*c*. The gearmotor 120*c* is operatively coupled to first and second leadscrew assemblies 121*c* by a gear linkage 400. More specifically, the gearmotor 120*c* has an output shaft with helical threads 402 providing a worm gear which operatively engages with a transverse gear 404 such that rotation of the output shaft of the gearmotor 120*c* rotates the helical threads 402, which in turn rotates the gear 404. The gear 404 is rotatably fixed to driveshafts 406 on either side of the gear 404 such that rotation of the gear 404 causes rotation of the driveshafts 406. The outer ends of the driveshafts 406 are coupled to the lead screws 123*c* of the leadscrew assemblies 121*c* by bevel gearsets 408 such that rotation of the driveshafts 406 causes rotation of the lead screws 123*c*. Rotation of the lead screws 123*c* extends/retracts the leadnut and tube assemblies 125*c*, as shown by arrows in FIG. 17 and similar to the third example described herein above, to adjust the elliptical path of travel of the foot pads 90 during the striding motion. The example configuration of the gear linkage 400, as shown in FIGS. 15-17, has first and second lead screws 123*c* (and corresponding nuts) with opposing threads, respectively, one having right hand threads, the other having left hand threads, such that operation of the gearmotor 120*c* in one direction simultaneously causes extension on both sides and such that operation of the gearmotor 120*c* in the opposition direction simultaneously causes retraction on both sides.

Figure 18:
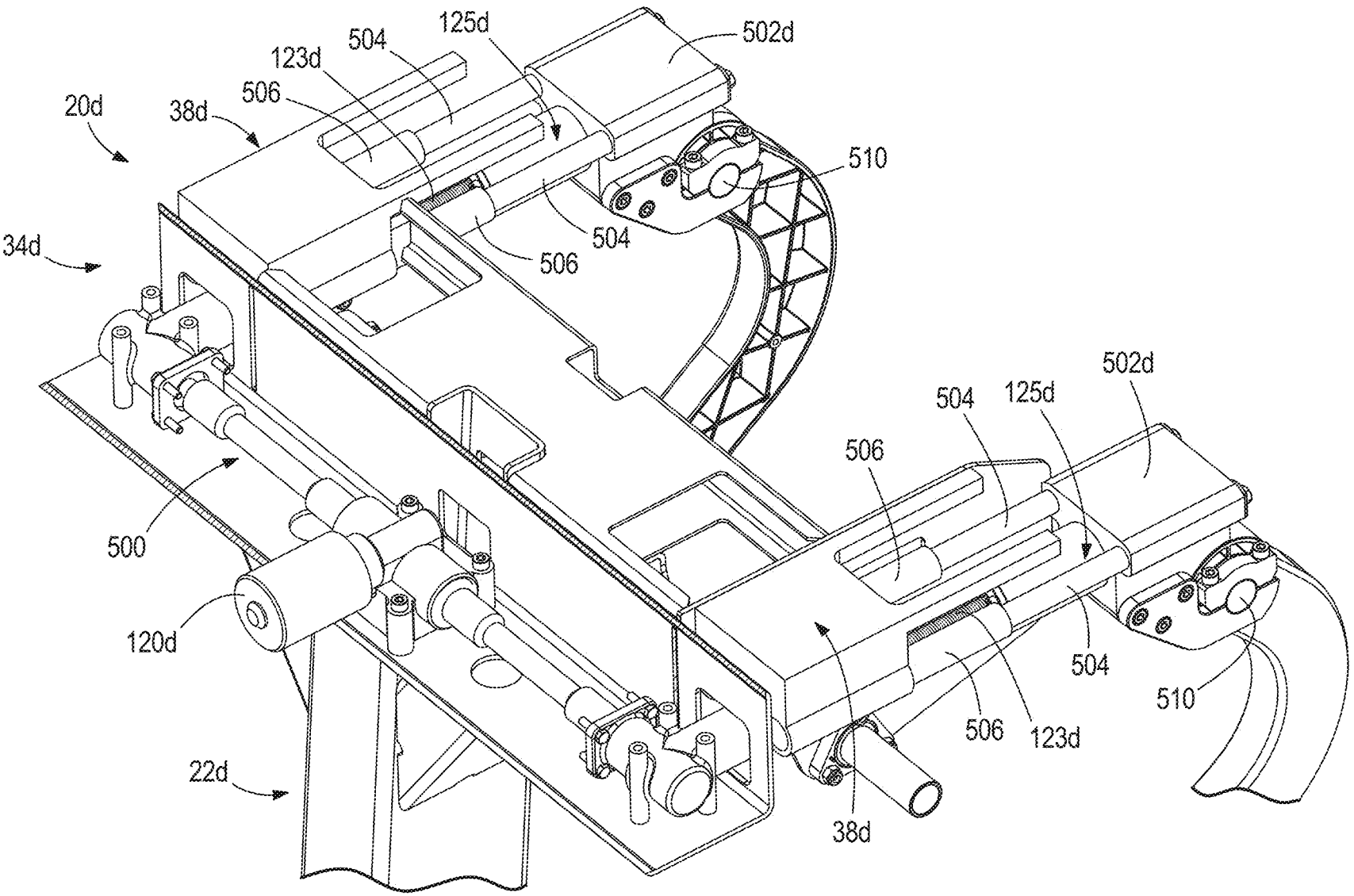
FIG. 18 is a front perspective view looking down at a fifth non-limiting example of an exercise machine according to the present disclosure.
Figure 19:
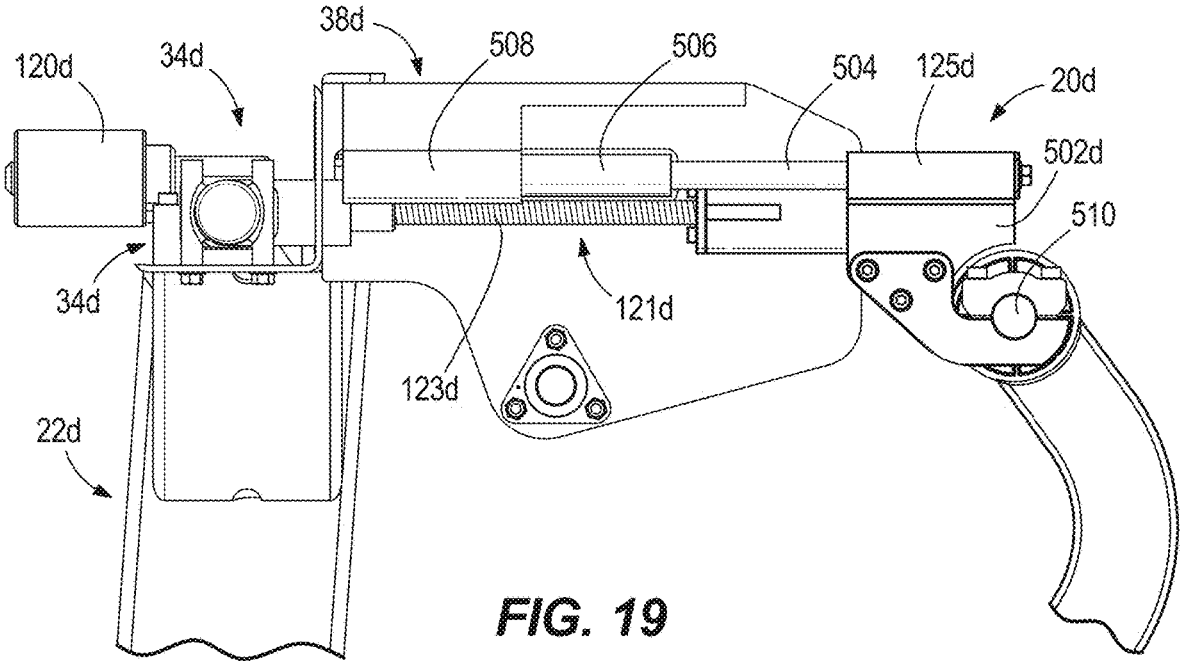
FIG. 19 is a side sectional view of the fifth example.
Figure 20:
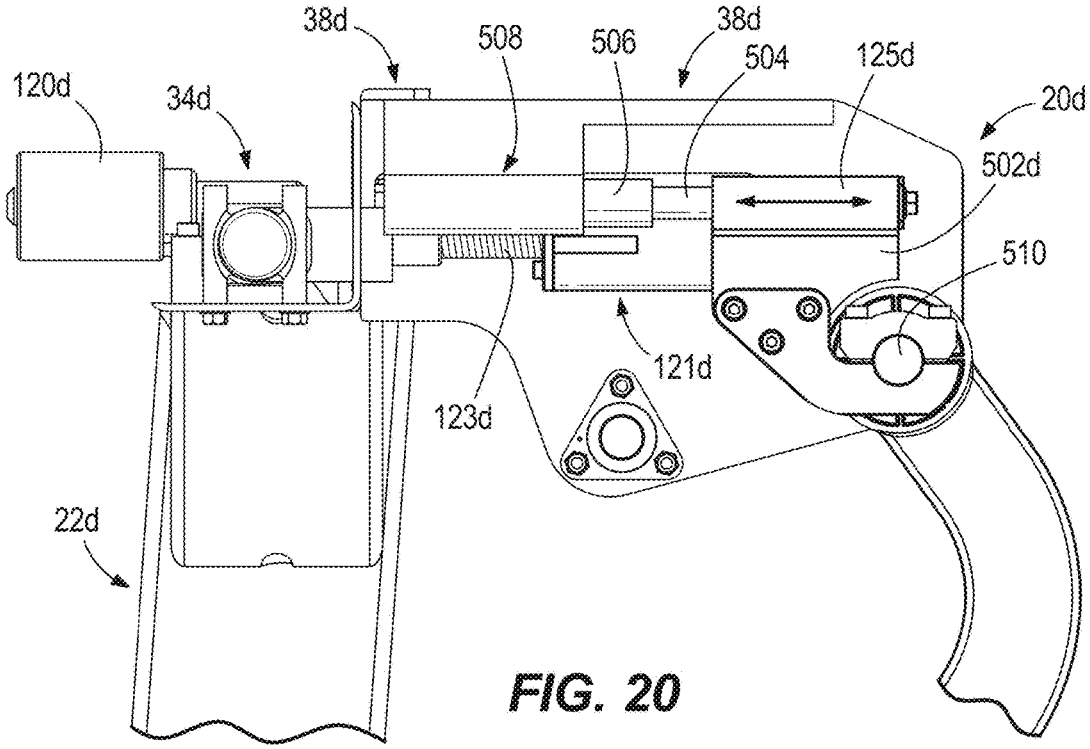
FIG. 20 is another side view of the fifth example.

FIGS. 18-20 illustrate a fifth example of an exercise machine 20*d*. The figures only show aspects of the bridge 34*d* of the machine 20*d*. It should be understood that in a non-limiting example, the remainder of the machine 20*d* is configured like the machine 20 shown in FIGS. 1-7 and described herein above. Like features are designated with like reference numbers having a "d" designation.

The fifth example of the machine 20*d* is like the fourth example 20*c*, except instead of being supported by guides which are shafts, the carriage 502*d* is supported by guides comprising a series of telescoping shafts 504, 506, 508. Rotation of the gearmotor 120*d* rotates the gear linkage 500, which in turn rotates the lead screw 123*d* of the leadscrew assembly 121*d*. This extends or retracts the leadnut and tube assembly 125*d*, depending upon the direction of rotation, as described herein above. Extending or retracting of the leadnut and tube assembly 125*d* linearly moves the location of the adjustment device-rocker arm pivot axis 510 rearwardly or forwardly relative to the frame 22*d*, as described herein above and shown by comparison of FIGS. 19 and 20. Movement of the carriage 502*d* is supported by the telescoping shafts 504, 506, 508, as shown by comparison of FIGS. 19 and 20. The number of telescoping shafts can vary from what is shown. The telescoping shafts 504, 506, 508 advantageously provides a more compact arrangement in which the carriage 502*d* is extendable out of the arms 38*d* of the bridge 34*d* and retractable back into the arms 38*d* of the bridge 34*d*.

Although specific advantages have been enumerated above, various examples may include some, none, or all of the enumerated advantages. Other technical advantages may become readily apparent to one of ordinary skill in the art after review of the following figures and description. Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

What is claimed is:

1. An exercise machine for performing a striding exercise motion, the exercise machine comprising:

a frame;

first and second pedal members;

first and second foot pads on the first and second pedal members, respectively, wherein the first and second foot pads are configured to move in respective elliptical paths during the striding exercise motion;

first and second rocker arms, wherein the first and second pedal members are pivotably coupled to the first and second rocker arms and move with the first and second rocker arms relative to the frame;

an adjustment device that pivotably couples the first and second rocker arms to the frame, the adjustment device being configured to actively adjust and set a position of the first and second rocker arms relative to the frame, respectively, which thereby changes an incline shape of the elliptical paths, respectively, during the striding exercise motion; and first and second incline links that pivotably couple the first and second rocker arms to the frame, wherein each of the first and second incline links is pivotably coupled to the frame at an incline link-frame pivot axis, to a respective one of the first and second rocker arms at an incline link-rocker arm pivot axis, and to the adjustment device at an actuator-incline link pivot axis;

wherein the adjustment device is configured to pivot the first and second incline links rearwardly relative to the frame which moves the incline link-rocker arm pivot axis rearwardly relative to the frame, which raises the incline shape of the elliptical paths, and wherein the adjustment device is further configured to pivot the first and second incline links forwardly relative to the frame which moves the incline link-rocker arm pivot axis forwardly relative to the frame, which lowers the incline shape of the elliptical paths.

2. The exercise machine according to claim 1, wherein the adjustment device comprises first and second linear actuators each having a first end pivotably coupled to the frame and a second end pivotably coupled to a respective one of the first and second incline links.

3. The exercise machine according to claim 1, wherein the first and second pedal members each has a front end portion that is pivotably coupled to a lower end portion of a respective one of the first and second rocker arms at a rocker arm-pedal member pivot axis so that each of the first and second pedal members is pivotably movable relative to the respective one of the first and second rocker arms and relative to the frame and so that pivoting of the first and second rocker arms relative to the frame causes commensurate pivoting and translating of the first and second pedal members relative to the frame.

4. The exercise machine according to claim 1, further comprising first and second handle members that are pivotably coupled to opposite sides of a bridge on the frame at a respective handle member-bridge pivot axis.

5. The exercise machine according to claim 4, wherein each of the first and second handle members comprises an upper end providing a hand grip for manually grasping by a user performing the striding exercise motion and a lower end which is pivotably coupled to a respective coupler link at a handle-member coupler link pivot axis so that the first and second handle members and coupler links pivot together about the respective handle member-bridge pivot axis, respectively.

6. The exercise machine according to claim 5, wherein each of the coupler links has a forward end portion coupled to a respective one of the first and second handle members at the handle-member coupler link pivot axis and a rearward end portion pivotably coupled to a central portion of a the respective one of the first and second pedal members at a coupler link-pedal member pivot axis so that each coupler link is pivotable relative to the respective one of the first and second pedal members about the coupler link-pedal member pivot axis.

7. An exercise machine for performing a striding exercise motion, the exercise machine comprising:

a frame;

first and second pedal members;

first and second foot pads on the first and second pedal members, respectively, wherein the first and second foot pads are configured to move in respective elliptical paths during the striding exercise motion;

first and second rocker arms, wherein the first and second pedal members are pivotably coupled to the first and second rocker arms and move with the first and second rocker arms relative to the frame;

an adjustment device that pivotably couples the first and second rocker arms to the frame, the adjustment device being configured to actively adjust and set a position of the first and second rocker arms relative to the frame, respectively, which thereby changes an incline shape of the elliptical paths, respectively, during the striding exercise motion;

wherein each of the first and second pedal members has a forward end pivotably coupled to the first and second rocker arms, respectively, and wherein each of the first and second pedal members further has a rearward end pivotably coupled to a resistance device;

first and second crank arms that are radially opposed to each other, wherein each of the first and second crank arms has a radially inner end that is rotatably fixed to a center shaft at a rear of the exercise machine, the center shaft being coupled to the resistance device;

first and second stride links that are pivotably coupled to radially outer ends of the first and second crank arms, respectively, and further being pivotably coupled to a tail portion of the first and second pedal members, respectively;

first and second idler links having a first end that is pivotably coupled to a base member of the frame at an idler link-base member pivot axis and a second end that is pivotably coupled to a lower end of a respective one of the first and second stride links at a stride-link-idler link pivot axis.

* * * * *